US011592233B2

(12) United States Patent
Choi

(10) Patent No.: US 11,592,233 B2
(45) Date of Patent: Feb. 28, 2023

(54) REFRIGERATOR

(71) Applicant: LG ELECTRONICS INC., Seoul (KR)

(72) Inventor: Seonwoo Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 311 days.

(21) Appl. No.: 16/582,668

(22) Filed: Sep. 25, 2019

(65) Prior Publication Data

US 2021/0010745 A1 Jan. 14, 2021

(30) Foreign Application Priority Data

Jul. 12, 2019 (KR) ..... 10-2019-0084451

(51) Int. Cl.

| | |
|---|---|
| ***F25D 25/02*** | (2006.01) |
| ***F25D 25/00*** | (2006.01) |
| *F25D 11/02* | (2006.01) |
| *A47B 88/457* | (2017.01) |

(52) U.S. Cl.

CPC ..... *F25D 25/005* (2013.01); *F25D 25/025* (2013.01); *A47B 88/457* (2017.01); *F25D 11/02* (2013.01); *F25D 2325/021* (2013.01)

(58) Field of Classification Search

CPC ..... F25D 25/005; F25D 25/025; F25D 2325/021; A47B 88/90; A47B 88/457

See application file for complete search history.

(56) References Cited

U.S. PATENT DOCUMENTS

| | | | |
|---|---|---|---|
| 658,999 | A | 10/1900 | Scannel |
| 1,067,404 | A | 7/1913 | Callaghan |
| 2,072,244 | A | 3/1937 | Coursen |
| 2,679,658 | A | 6/1954 | McCormick |
| 2,731,318 | A | 1/1956 | Hoff |
| 4,545,628 | A | 10/1985 | Richey |
| 5,253,488 | A | 10/1993 | Kim et al. |
| 6,044,606 | A | 4/2000 | Hamar |
| 6,109,774 | A | 8/2000 | Holmes et al. |
| 6,371,584 | B1 | 4/2002 | Alreck |
| 6,722,749 | B1 | 4/2004 | Pagac |
| 7,600,829 | B2 | 10/2009 | Oh et al. |
| 7,600,830 | B2 | 10/2009 | Oh et al. |
| 7,600,833 | B2 | 10/2009 | Oh et al. |

(Continued)

FOREIGN PATENT DOCUMENTS

| | | |
|---|---|---|
| CN | 100417900 | 9/2008 |
| CN | 101981397 | 2/2011 |

(Continued)

OTHER PUBLICATIONS

European Search Report dated Apr. 1, 2020 issued in EP Application No. 19199637.0.

(Continued)

*Primary Examiner* — Kimberley S Wright

(74) *Attorney, Agent, or Firm* — KED & Associates, LLP

(57) ABSTRACT

A refrigerator may include a cabinet, a drawer, a driving part, a cable tray, and a rack gear assembly. Connecting members of the cable tray may be maintained in an anti-sagging state by a tray guide part, so that friction noise generated during moving of the cable tray is prevented and interference with the cable tray during moving of the drawer is prevented.

20 Claims, 30 Drawing Sheets

(56) References Cited

U.S. PATENT DOCUMENTS 7,690,586 B2 4/2010 Kang
8,282,177 B1 10/2012 Rotter
8,360,539 B2 1/2013 Brown et al.
8,376,481 B2 2/2013 Lee
8,497,644 B2 7/2013 Eom et al.
8,668,289 B2 3/2014 Lee et al.
8,794,722 B2 8/2014 Nuss et al.
8,844,110 B2 9/2014 Rotter
8,864,249 B2 10/2014 Nam et al.
9,107,494 B2 * 8/2015 Scheuring ..... A47B 51/00
9,377,238 B2 * 6/2016 Hall ..... F25D 25/025
9,523,533 B2 12/2016 Nam et al.
9,982,937 B2 5/2018 Tierney et al.
10,234,195 B2 3/2019 Yasaka et al.
10,465,970 B1 11/2019 Kang et al.
10,598,428 B2 * 3/2020 Kim ..... F25D 23/028
10,690,401 B2 6/2020 Yang et al.
10,712,083 B1 7/2020 Choi
10,767,920 B1 9/2020 Choi
10,786,080 B1 9/2020 Stravitz et al.
10,876,788 B2 12/2020 Choi
10,932,568 B2 3/2021 Subrahmanya et al.
10,939,758 B2 3/2021 Kim
11,033,104 B2 6/2021 Kim
11,047,619 B2 6/2021 Choi
11,131,500 B2 9/2021 Kim
2003/0201700 A1 10/2003 Cho
2004/0031705 A1 2/2004 Detemple, II et al.
2004/0046488 A1 3/2004 Hogan
2004/0056573 A1 3/2004 Chae
2006/0042306 A1 3/2006 Choi et al.
2006/0087207 A1 4/2006 Oh et al.
2006/0087208 A1 * 4/2006 Oh ..... F25D 25/025
312/402
2006/0207283 A1 9/2006 Kim et al.
2006/0248916 A1 11/2006 Kim et al.
2006/0250062 A1 11/2006 Janda et al.
2007/0262686 A1 11/2007 Ji
2008/0018215 A1 1/2008 Carden et al.
2009/0045713 A1 2/2009 Kunkle et al.
2009/0160298 A1 6/2009 Chen et al.
2009/0167131 A1 7/2009 Oh et al.
2009/0277210 A1 11/2009 Eveland et al.
2010/0192621 A1 8/2010 Kim
2010/0236279 A1 9/2010 Eom et al.
2010/0239795 A1 9/2010 Gat
2010/0283365 A1 11/2010 Chen
2011/0005264 A1 * 1/2011 Lee ..... F25D 25/025
62/449
2011/0006656 A1 1/2011 Nam et al.
2011/0050065 A1 * 3/2011 Lee ..... F25D 23/028
312/402
2011/0050066 A1 3/2011 Lee et al.
2011/0146333 A1 * 6/2011 Koo ..... F25D 31/005
62/441
2011/0162402 A1 * 7/2011 Park ..... F25D 27/00
62/264
2011/0181163 A1 * 7/2011 Han ..... F25D 23/028
312/405
2011/0210655 A1 9/2011 Brown et al.
2012/0091872 A1 4/2012 Matthes et al.
2012/0125035 A1 5/2012 Chellappan et al.
2012/0306338 A1 12/2012 Nagahata et al.
2013/0055543 A1 3/2013 Rotter
2013/0129267 A1 5/2013 Chen
2013/0145972 A1 6/2013 Knox et al.
2013/0264928 A1 10/2013 Hong et al.
2013/0270986 A1 10/2013 Min et al.
2013/0270987 A1 10/2013 Kelly
2013/0270989 A1 10/2013 Park et al.
2014/0191646 A1 7/2014 Nuss et al.
2014/0265783 A1 9/2014 Hauer et al.
2014/0265797 A1 * 9/2014 Scheuring ..... A47B 51/00
312/404
2014/0265806 A1 * 9/2014 Hall ..... F25D 25/025
312/408
2014/0319990 A1 10/2014 Gephart et al.
2015/0059398 A1 3/2015 Yoo et al.
2015/0059399 A1 3/2015 Hwang et al.
2015/0069899 A1 * 3/2015 Han ..... F25D 23/028
312/404
2015/0184918 A1 7/2015 Klingshirn et al.
2016/0146533 A1 5/2016 Jung
2016/0153704 A1 6/2016 Burke et al.
2016/0178274 A1 6/2016 Shin
2016/0265816 A1 9/2016 Gillette et al.
2016/0305705 A1 10/2016 Dubina et al.
2016/0320118 A1 11/2016 Millett
2016/0370063 A1 12/2016 Yang
2017/0024946 A1 * 1/2017 Hashemi ..... A47G 29/20
2017/0051967 A1 2/2017 Tierney et al.
2017/0122651 A1 5/2017 Cizik et al.
2017/0227279 A1 8/2017 Yang et al.
2017/0336129 A1 11/2017 Cunningham
2017/0362864 A1 12/2017 Fazi et al.
2018/0128540 A1 5/2018 Yasaka et al.
2018/0283771 A1 10/2018 Shin et al.
2018/0291669 A1 10/2018 Kim et al.
2018/0356148 A1 12/2018 Fei et al.
2019/0219324 A1 7/2019 Kang
2019/0242640 A1 8/2019 Minoru et al.
2019/0292831 A1 9/2019 Choi
2019/0293341 A1 9/2019 Yeom
2019/0323763 A1 10/2019 Kang
2019/0346199 A1 11/2019 Choi
2019/0390895 A1 * 12/2019 Choi ..... F25D 25/025
2020/0011593 A1 1/2020 Ji
2020/0069056 A1 3/2020 Kim
2020/0072533 A1 3/2020 Cho
2020/0072540 A1 3/2020 Kim
2020/0072542 A1 3/2020 Kim
2021/0003337 A1 * 1/2021 Voltarelli ..... F25D 29/005
2021/0259416 A1 8/2021 Kim

FOREIGN PATENT DOCUMENTS

CN 102226626 10/2011
CN 202254607 5/2012
CN 202970226 6/2013
CN 204902419 12/2015
CN 107388718 11/2017
CN 108645104 10/2018
CN 109028726 12/2018
CN 208640001 3/2019
CN 109690213 4/2019
CN 208736030 4/2019
CN 109838961 6/2019
CN 109990557 7/2019
CN 110873500 3/2020
DE 29620152 4/1997
DE 10-2005-016418 11/2005
EP 1 724 540 11/2006
EP 2 299 215 3/2011
EP 2 752 632 7/2014
EP 3 023 721 5/2016
EP 3 505 854 7/2019
EP 3 546 862 10/2019
EP 3 617 630 3/2020
GB 2108564 5/1983
JP H 04-138337 12/1992
JP H 07-275049 10/1995
JP H 08-303944 11/1996
JP 2001-280824 10/2001
JP 2002-264943 9/2002
KR 10-2006-0025806 3/2006
KR 10-2006-0027592 3/2006
KR 10-2006-0053420 5/2006
KR 10-2007-0075671 7/2007
KR 10-2008-0101335 11/2008
KR 10-2009-0027111 3/2009
KR 10-2009-0027112 3/2009
KR 10-2009-0102576 9/2009
KR 10-2009-0102577 9/2009

(56) References Cited

FOREIGN PATENT DOCUMENTS

| | | | |
|---|---|---|---|
| KR | 10-0921380 | 10/2009 | |
| KR | 10-2009-0114265 | 11/2009 | |
| KR | 10-2010-0012544 | 2/2010 | |
| KR | 10-0946784 | 3/2010 | |
| KR | 10-2010-0078916 | 7/2010 | |
| KR | 10-2011-0014331 | 2/2011 | |
| KR | 10-2011-0015331 | 2/2011 | |
| KR | 20-0460442 | 6/2012 | |
| KR | 10-2013-0071919 | 7/2013 | |
| KR | 10-2014-0037474 | 3/2014 | |
| KR | 10-2018-0138083 | 12/2018 | |
| KR | 10-2018-0138085 | 12/2018 | |
| KR | 10-2019-0081331 | 7/2019 | |
| WO | 92/14522 | 9/1992 | |
| WO | WO 03/016661 | 2/2003 | |
| WO | WO 2018/051963 | 3/2018 | |
| WO | WO-2019242234 A1 * | 12/2019 | ..... F25D 25/025 |

OTHER PUBLICATIONS

United States Office Action dated Nov. 19, 2020 issued in co-pending related U.S. Appl. No. 16/582,831.
European Search Report dated Mar. 23, 2020 issued in EP Application No. 19199602.4.
European Office Action dated Sep. 30, 2020 issued in EP Application No. 19199556.2.
United States Office Action dated Mar. 4, 2020 issued in U.S. Appl. No. 16/582,712.
United States Office Action dated Mar. 9, 2020 issued in U.S. Appl. No. 16/582,810.
European Search Report dated Aug. 14, 2020 issued in EP Application No. 19199647.9.
European Search Report dated Mar. 12, 2020 issued in Application No. 19199586.9.
European Search Report dated Mar. 17, 2020 issued in Application No. 19199553.9.
European Search Report dated Mar. 20, 2020 issued in Application No. 19199569.5.
European Search Report dated Mar. 30, 2020 issued in Application No. 19199556.2.
European Search Report dated Apr. 3, 2020 issued in Application No. 19199625.5.
European Search Report dated Apr. 6, 2020 issued in Application No. 19199587.7.
European Search Report dated Apr. 6, 2020 issued in Application No. 19199629.7.
European Search Report dated Apr. 7, 2020 issued in Application No. 19199607.3.
Chinese Office Action dated Sep. 3, 2021 issued in CN Application No. 201910905106.9.
European Communication dated Feb. 8, 2021 issued in EP Application No. 19199627.1.
United States Notice of Allowance dated Feb. 23, 2022 issued in co-pending related U.S. Appl. No. 16/582,518.
United States Notice of Allowance dated Feb. 23, 2022 issued in co-pending related U.S. Appl. No. 16/585,284.
GE (Refrigerator Freezer Door Pops Open, https://products.geapplicances.com/appliance/gea-support-search-content?contentId=16979) (Year: 2015).
United States Office Action dated Apr. 11, 2022 issued in co-pending related U.S. Appl. No. 16/585,301.
Chinese Office Action dated May 16, 2022 issued in CN Application No. 201910905106.9.
U.S. Appl. No. 16/583,726, filed Sep. 26, 2019.
U.S. Appl. No. 16/582,647, filed Sep. 25, 2019.
U.S. Appl. No. 16/582,605, filed Sep. 25, 2019.
U.S. Appl. No. 16/582,518, filed Sep. 25, 2019.
U.S. Appl. No. 16/585,284, filed Sep. 27, 2019.
Chinese Office Action dated Aug. 20, 2021 issued in CN Application No. 201910857469.X.
Chinese Office Action dated Aug. 25, 2021 issued in CN Application No. 201910911807.3.
Chinese Office Action dated Sep. 2, 2021 issued in CN Application No. 201910871084.9.
Chinese Office Action dated Sep. 17, 2021 issued in CN Application No. 201910905094.X.
United States Office Action dated Oct. 6, 2021 issued in co-pending related U.S. Appl. No. 16/583,726.
United States Office Action dated Oct. 6, 2021 issued in co-pending related U.S. Appl. No. 16/582,647.
Chinese Office Action dated Aug. 24, 2021 issued in CN Application No. 201910911796.9.
Chinese Office Action dated Sep. 8, 2021 issued in CN Application No. 201910857458.1.
Chinese Office Action dated Sep. 14, 2021 issued in CN Application No. 201910905166.0.
United States Office Action dated Oct. 15, 2021 issued in co-pending related U.S. Appl. No. 16/582,755.
European Office Action dated Sep. 1, 2021 issued in EP Application No. 19199607.3.
United States Office Action dated Jan. 31, 2022 issued in co-pending related U.S. Appl. No. 16/582,756.
United States Office Action dated Feb. 2, 2022 issued in co-pending related U.S. Appl. No. 16/582,605.
U.S. Appl. No. 16/582,756, filed Sep. 25, 2019.
U.S. Appl. No. 16/582,668, filed Sep. 25, 2019.
U.S. Appl. No. 16/582,755, filed Sep. 25, 2019.
U.S. Appl. No. 17/880,665, filed Aug. 4, 2022.
U.S. Appl. No. 17/830,750, filed Jun. 2, 2022.
U.S. Appl. No. 16/585,301, filed Sep. 27, 2019.
U.S. Appl. No. 16/585,816, filed Sep. 27, 2019.
United States Office Action dated Oct. 14, 2022 issued in co-pending related U.S. Appl. No. 16/585,816.

* cited by examiner

REFRIGERATOR

CROSS-REFERENCE TO RELATED APPLICATION

The present application claims priority to Korean Patent Application No. 10-2019-0084451, filed Jul. 12, 2019 in Korea, the entire contents of which is incorporated herein for all purposes by this reference.

BACKGROUND

1. Field

The present disclosure relates to a refrigerator having a drawer.

2. Background

A refrigerator is a home appliance that is provided to store various foods or beverages for a long time by cold air generated by circulation of a refrigerant according to a refrigeration cycle.

The refrigerator may be divided into two types of refrigerators: a common refrigerator that can store storage items a user wants to store regardless of a type of food or drink; and an exclusive-use refrigerator that varies in size or function based on a type of storage item to be stored.

The exclusive use refrigerator may include a kimchi refrigerator, a wine refrigerator, and so on.

The refrigerator may be classified into various types depending on a door opening and closing method of a storage chamber in a cabinet, such as a swinging door-type refrigerator, a drawer-type refrigerator, and a hybrid-type refrigerator having both doors and drawers. The hybrid-type refrigerator has a structure in which a swinging door is provided in an upper portion of the cabinet and a drawer is provided in a lower portion thereof.

The drawer provided in the drawer refrigerator or the hybrid-type refrigerator may open, by a user's operation, from an inside space of the cabinet in a sliding manner. The drawer may close by being pushed into the inside space of the cabinet by user's closing operation, thereby allowing an open front portion of the cabinet to be closed.

The drawer may include a front panel and a storage bin (or storage room), the front panel forming a front surface of the refrigerator and being moved forward and rearward, thereby allowing the inside space of the cabinet to be opened/closed and the storage bin being provided in rear of the front panel and received in the inside space of the cabinet. By pulling the front panel, the storage bin may open from the inside space of the cabinet, thus various foods can be stored in and taken out from the storage bin.

The drawer provided in the drawer refrigerator or the hybrid-type refrigerator is mainly provided in the lower portion of the cabinet. This is because, due to weight of storage items stored in the storage bin of the drawer, the drawer may be removed from the cabinet and fall down when the drawer is opened.

However, when the drawer is provided in the lower portion of the cabinet, the user may bend over at the waist while keeping away from the front panel by an appropriate distance for opening of the drawer.

Korean Patent Application Publication No. 10-2009-0102577, Korean Patent Application Publication No. 10-2009-0102576, Korean Patent Application Publication No. 10-2013-0071919, and Korean Patent Application Publication No. 10-2018-0138083, the subject matters of which is incorporated herein by reference, may disclose features of a refrigerator in which a drawer may be automatically opened.

A rack and a pinion may be used as a structure for automatically opening the drawer.

That is, the rack and the pinion may respectively installed in the drawer and the storage chamber in the cabinet, the storage chamber being opposite to the drawer, so that the drawer can be automatically opened forward.

However, guide racks each having a rack gear are respectively provided on opposite walls of the cabinet and pinions are respectively provided on opposite side walls (e.g., opposite sides of rear wall) of the storage bin (or storage room) of the drawer so that the drawer is moved forward and rearward. Therefore, a driving motor for driving the pinions should be provided in the drawer and power should be supplied to the driving motor.

However, considering that main power is supplied to each electronic part after entering the cabinet, when the electronic part is provided in the drawer, the electronic part requiring power supply such as the driving motor, a power line for power supply should also be installed to be moveable forward and rearward together with the drawer.

Considering that electronic parts and electrical components are additionally provided to supply various functions for each drawer even when the driving motor is not provided in the drawer, power supply to the drawer or cable connection for transmission of various signals may be considered essential.

Using a cable tray, cables connected to a moving part may move together to protect the cables and to prevent operational interference by the cables.

However, since a gap between a lower surface of the drawer and a bottom of storage chamber of the cabinet is narrow, when the cable tray is installed in the narrow gap, the cable tray may generate friction noise while contacting the bottom of the storage chamber or the lower surface of the drawer when the drawer is moved forward and rearward.

Contact may cause damage to the cable tray when the cable tray is operated, thereby causing exposure or damage of various cables stored in the cable tray.

BRIEF DESCRIPTION OF THE DRAWINGS

Arrangements and embodiments may be described in detail with reference to the following drawings in which like reference numerals refer to like elements, and wherein.

DETAILED DESCRIPTION

An exemplary embodiment with respect to a refrigerator of the present disclosure may be described in detail with reference to accompanying FIGS. 1 to 35.

Figure 1:
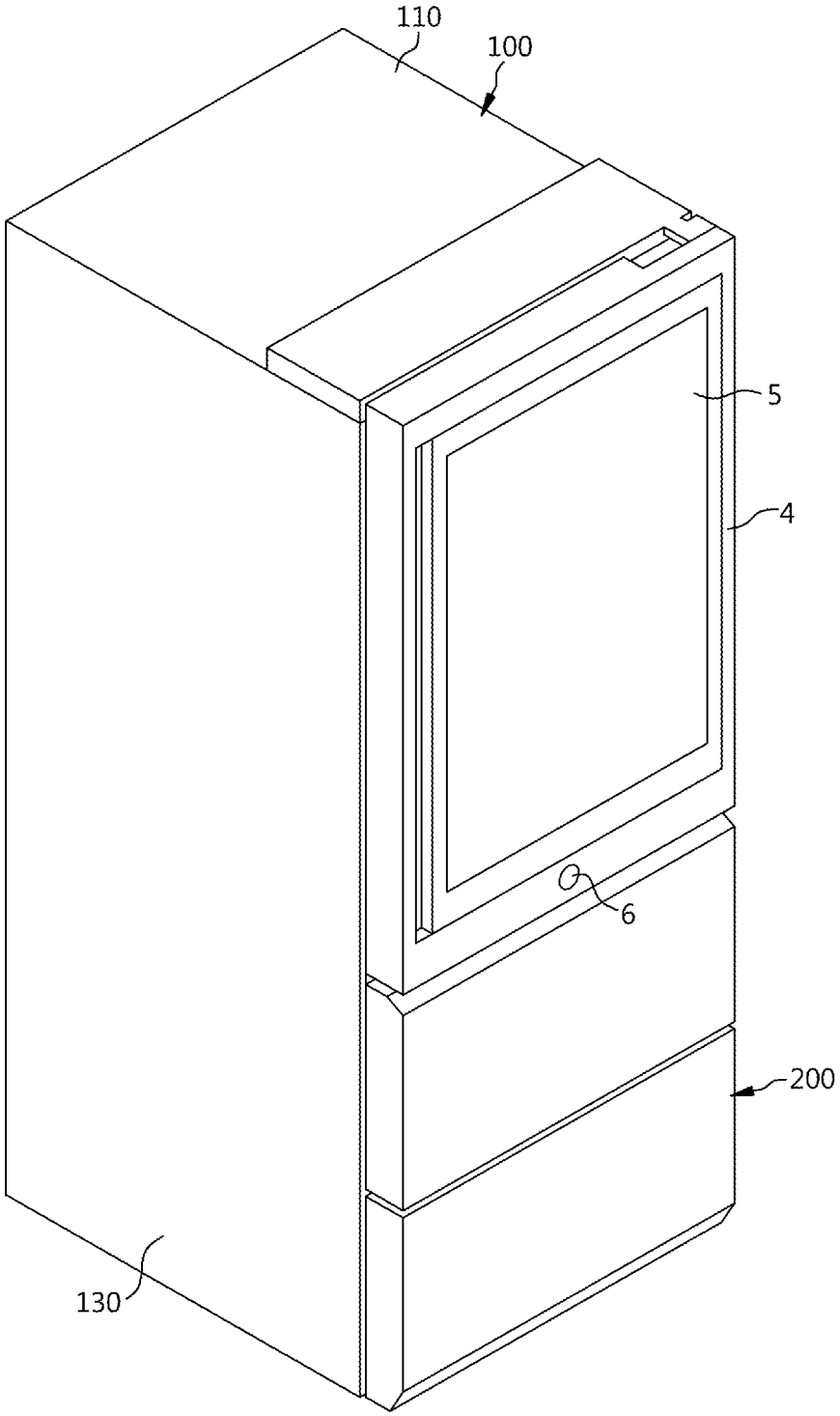
FIG. 1 is a perspective view showing a refrigerator according to an embodiment of the present disclosure.
Figure 2:
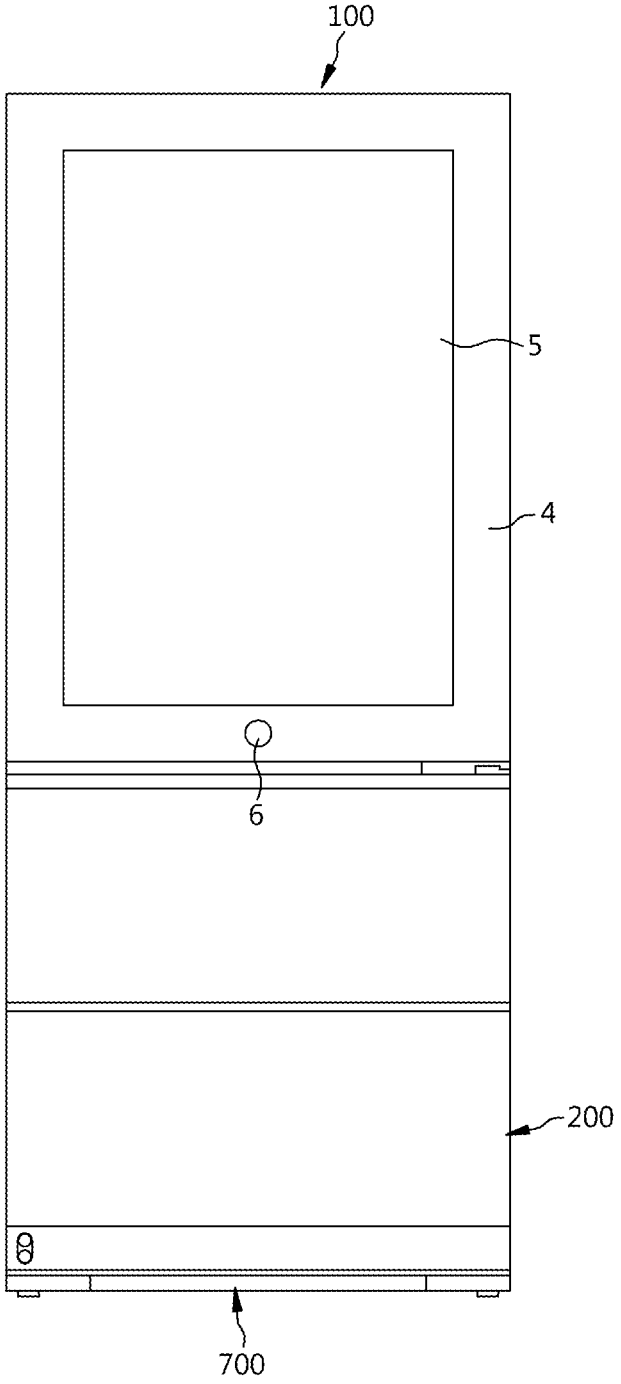
FIG. 2 is a front view showing the refrigerator according to an embodiment of the present disclosure.
Figure 3:
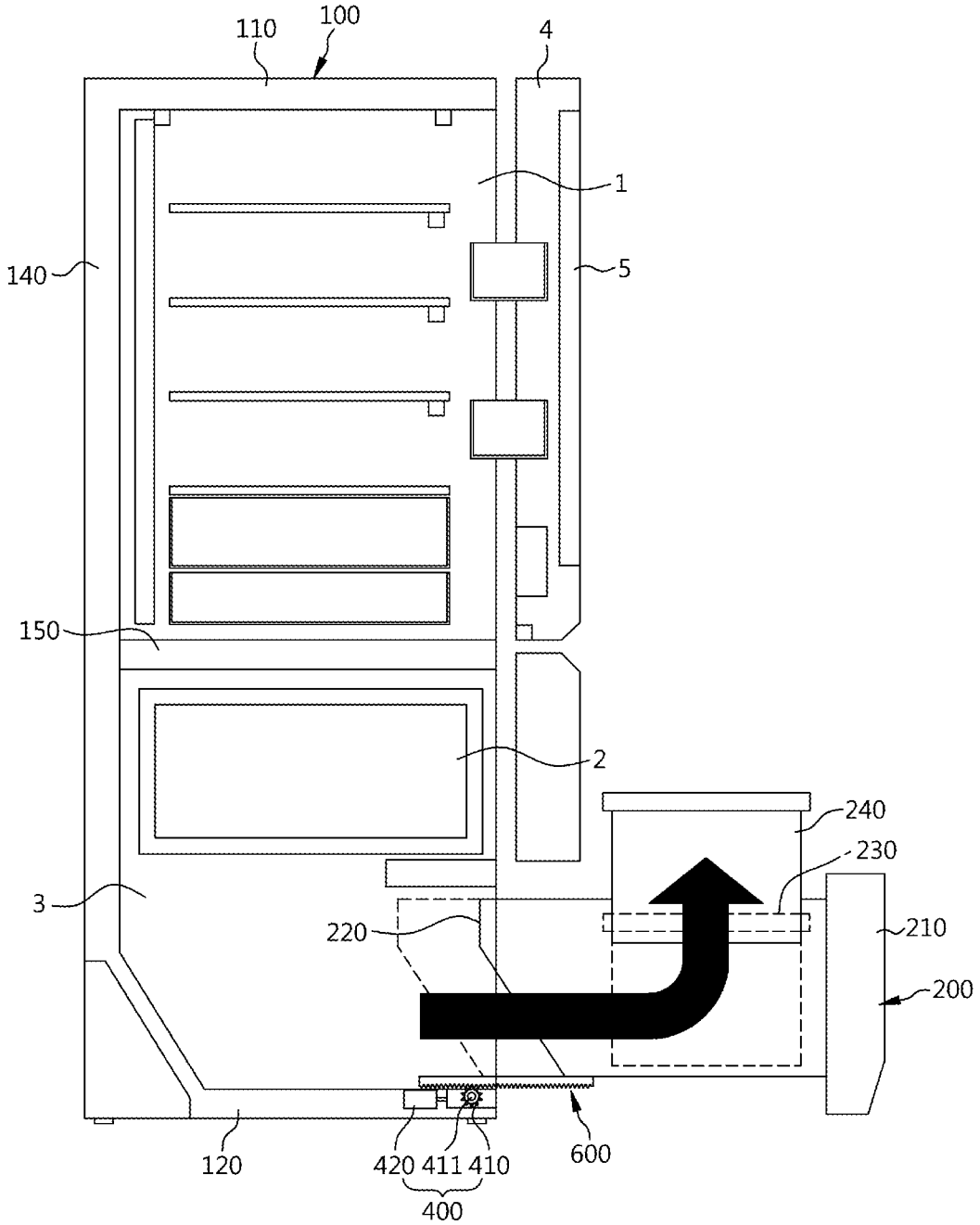
FIG. 3 is a side view showing the refrigerator according to an embodiment of the present disclosure.
Figure 4:
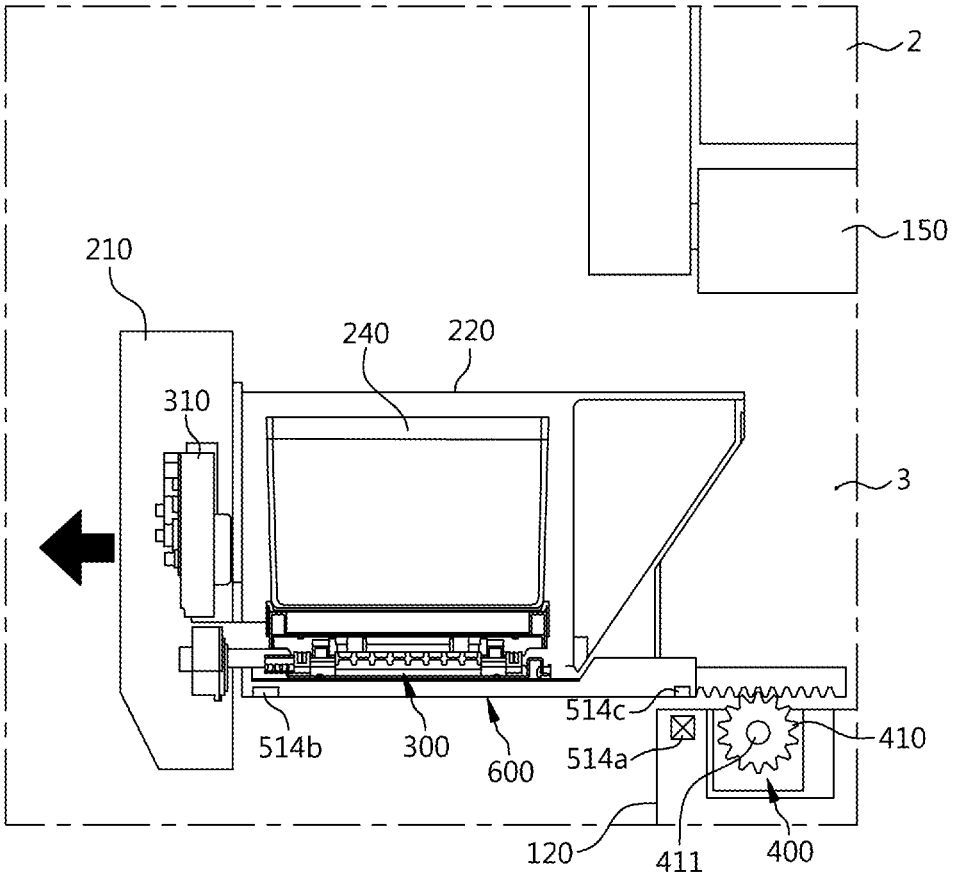
FIG. 4 is a main part view showing schematically the refrigerator according to the embodiment of the present disclosure, wherein a drawer of the refrigerator is opened.
Figure 5:
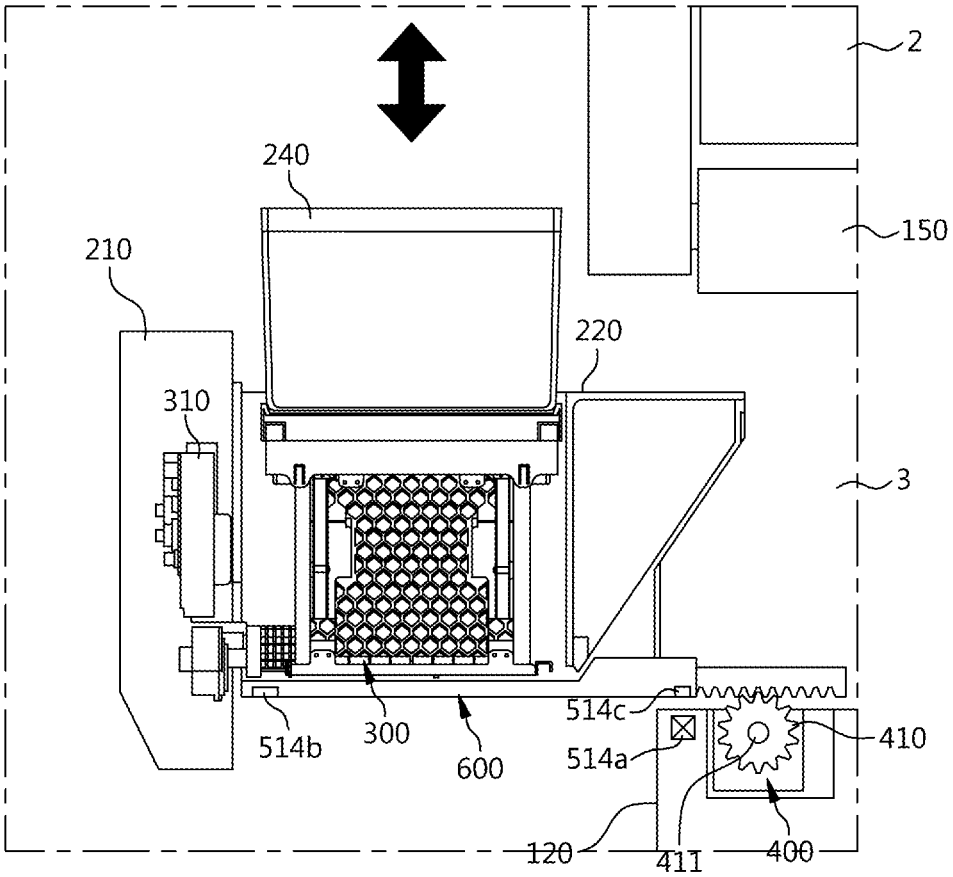
FIG. 5 is a main part view showing schematically the refrigerator according to the embodiment of the present disclosure, wherein a container is raised upward when the drawer of the refrigerator is opened.
Figure 6:
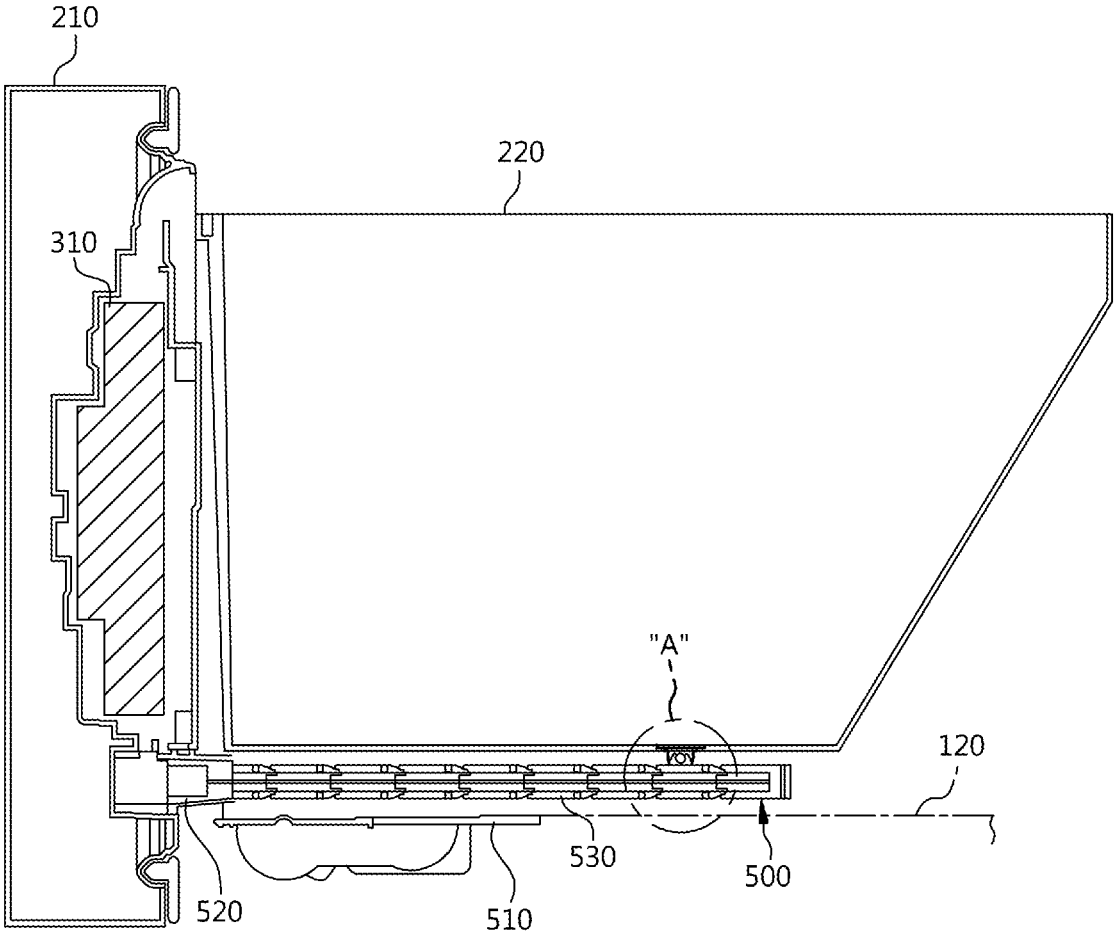
FIG. 6 is a side view showing the drawer of the refrigerator according to the embodiment of the present disclosure, the drawer being equipped with a cable guide module.
Figure 7:
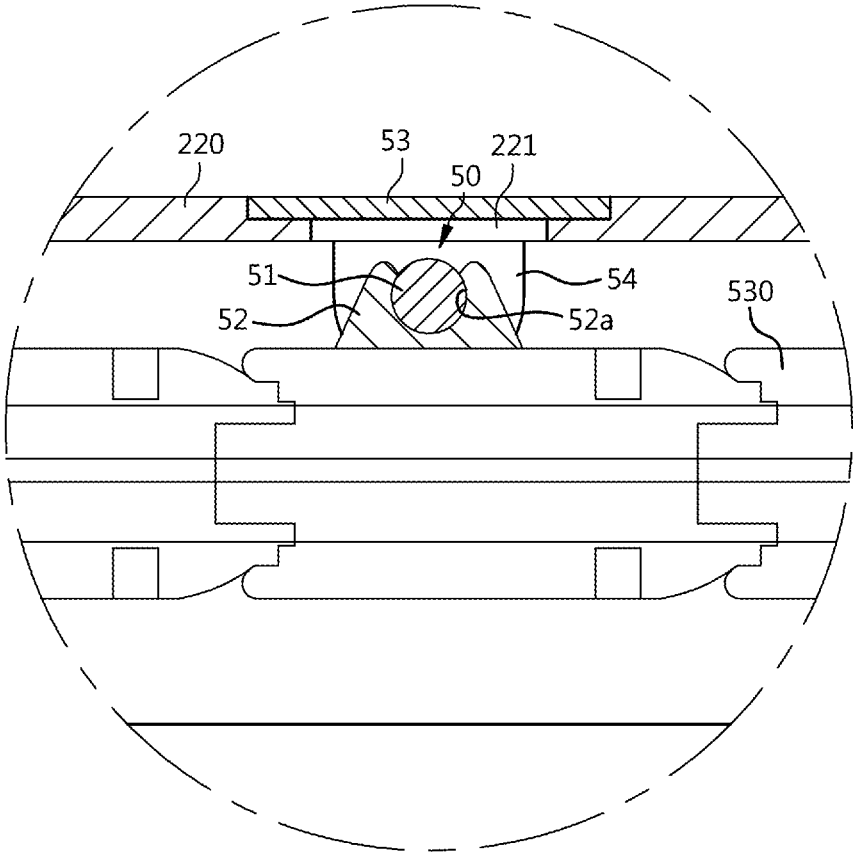
FIG. 7 is an enlarged view of "A" part in FIG. 6.
Figure 8:
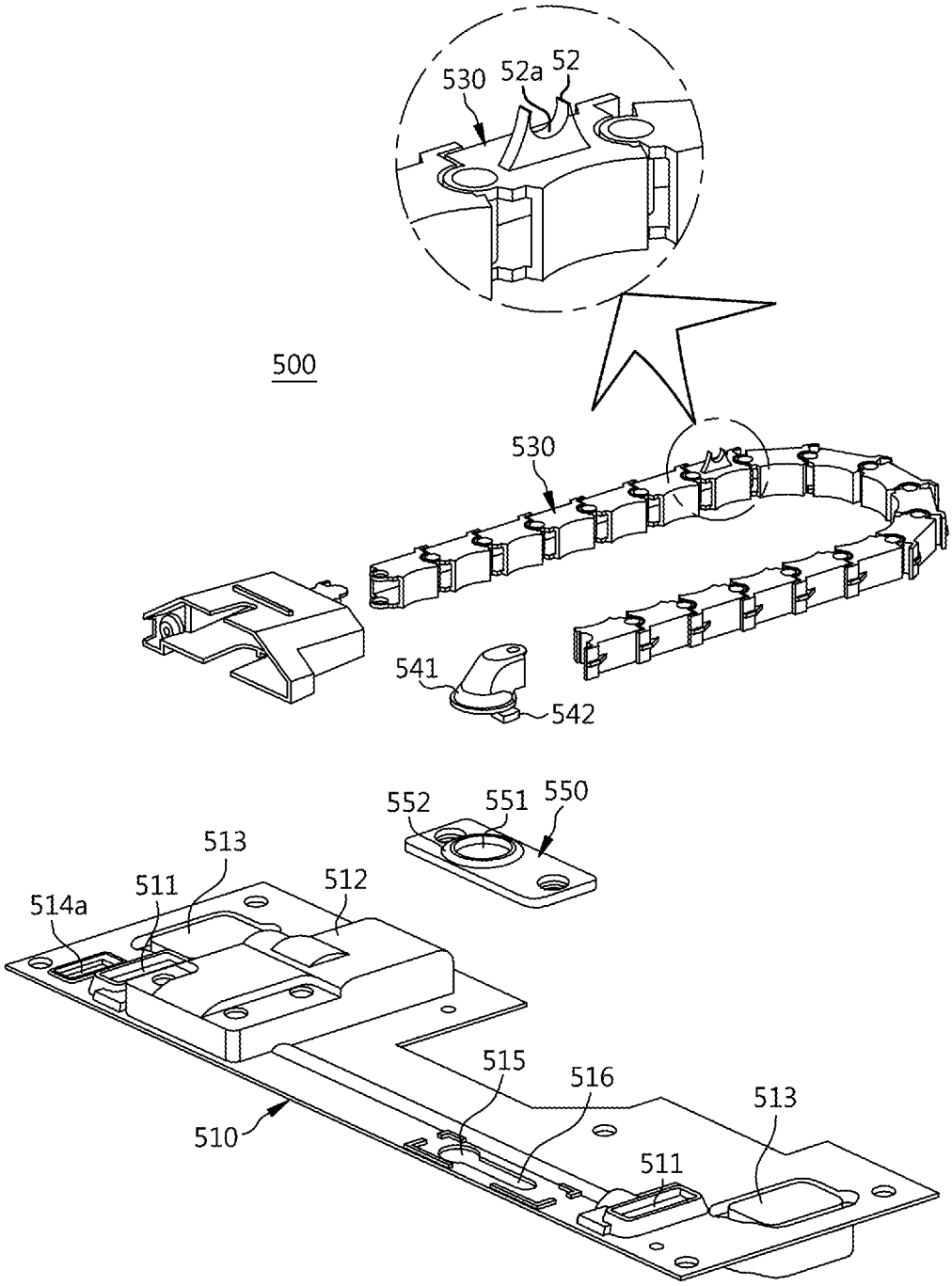
FIG. 8 is an exploded-perspective view showing the cable guide module of the refrigerator according to the embodiment of the present disclosure.
Figure 9:
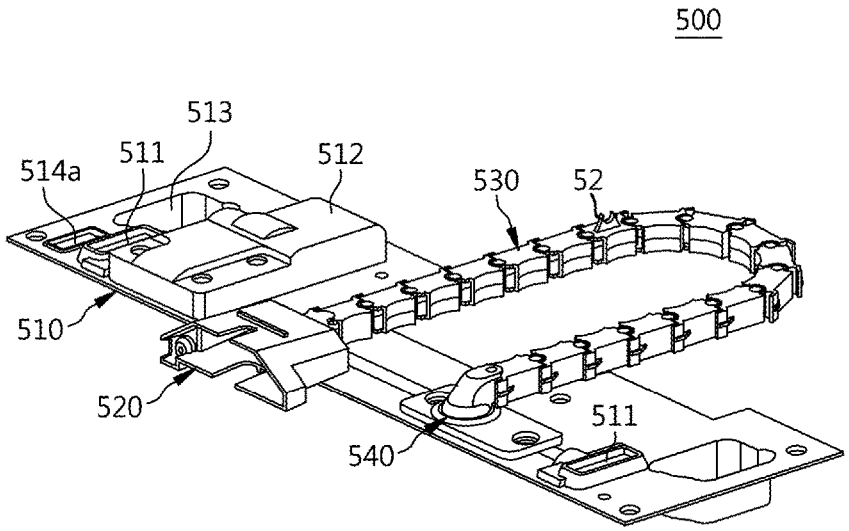
FIG. 9 is an assembled-perspective view showing the cable guide module of the refrigerator according to the embodiment of the present disclosure.
Figure 10:
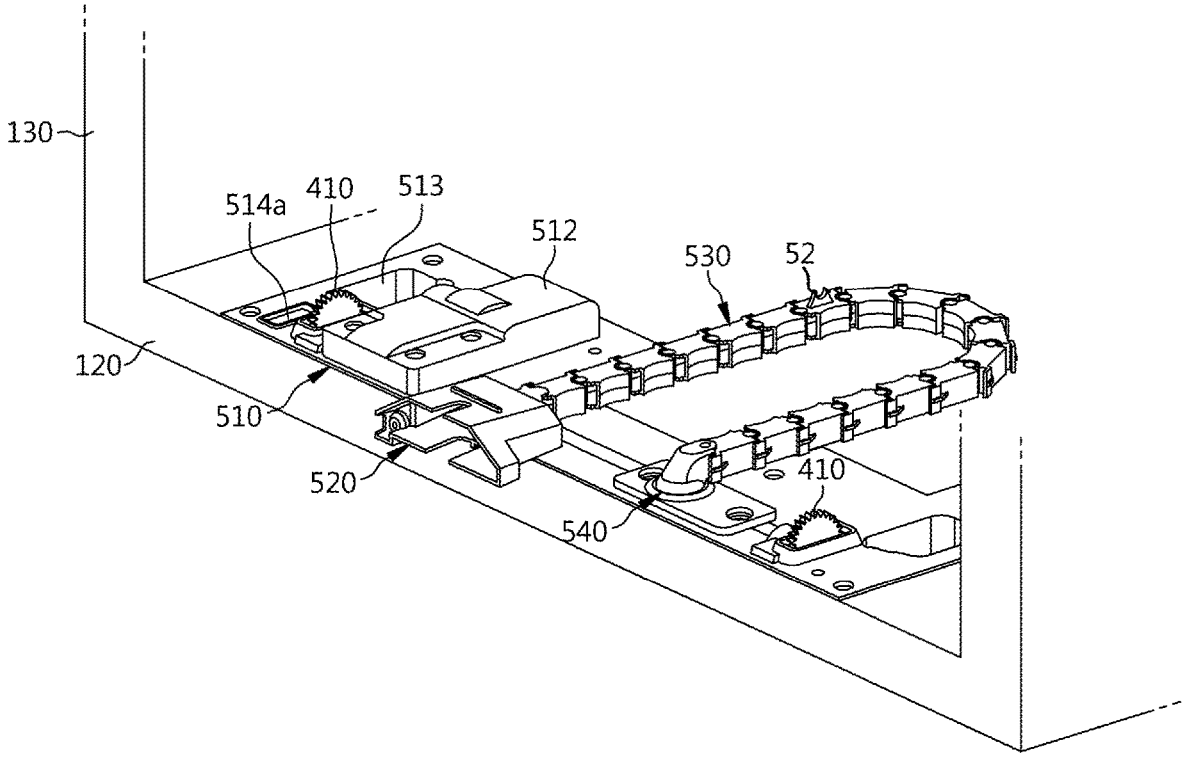
FIG. 10 is a perspective view showing an installation state of the cable guide module, the cable guide module of the refrigerator according to the embodiment of the present disclosure being installed in a storage chamber.
Figure 11:
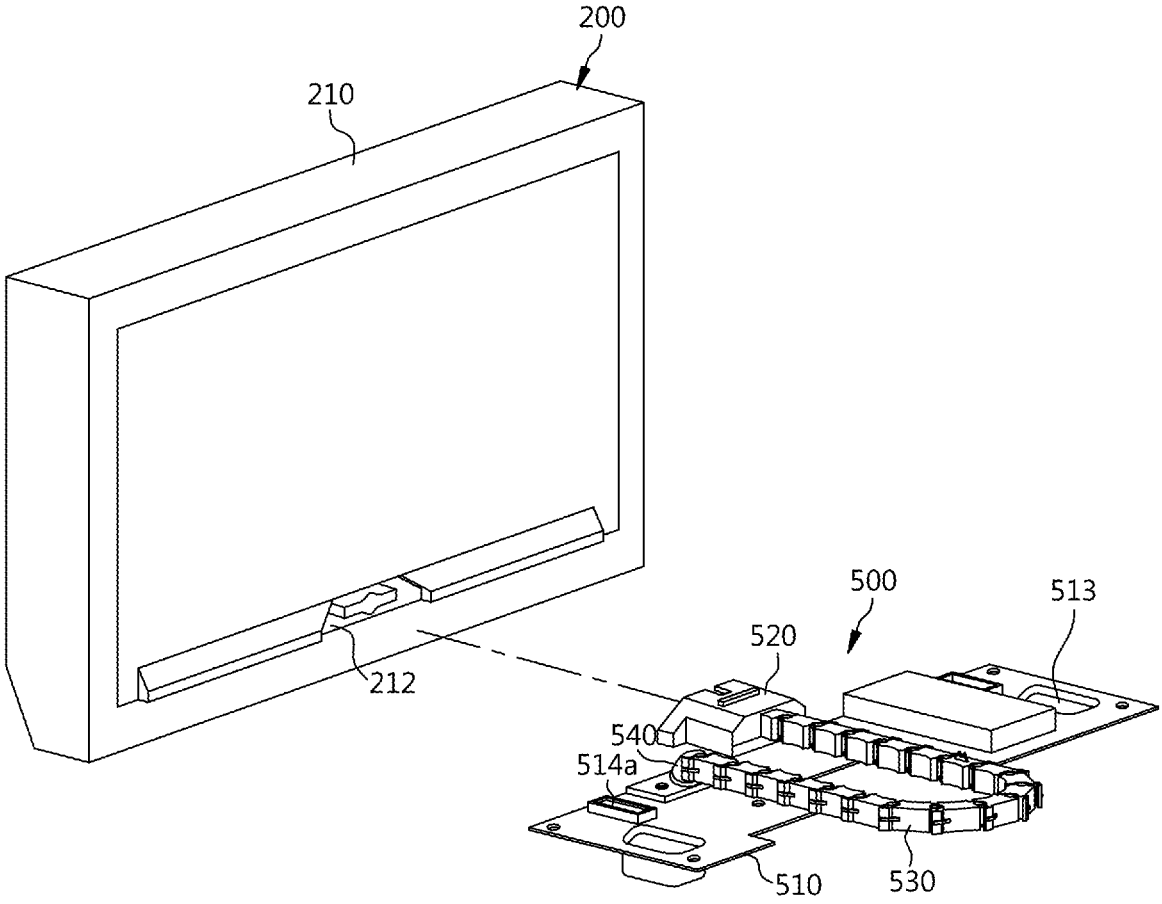
FIG. 11 is a perspective view showing the drawer at the rear side, wherein the cable guide module of the refrigerator according to the embodiment of the present disclosure is connected to the drawer.

FIG. 1 is a perspective view showing a refrigerator according to an embodiment of the present disclosure. FIG. 2 is a front view showing the refrigerator according to an embodiment of the present disclosure. FIG. 3 is a side view showing the refrigerator according to an embodiment of the present disclosure.

As shown in the drawings, a refrigerator according to an example embodiment of the present disclosure may include a cabinet 100, a drawer 200, a driving part 400, a cable tray 500, and a rack gear assembly 600. Connecting members 530 of the cable tray 500 may be maintained in a sag-prevented state by a tray guide part 50, so as to prevent scratch-noise generated when the cable tray 500 is moved and to prevent interference occurrence when the drawer is moved by the cable tray 500.

The cabinet 100 may constitute an outer appearance of the refrigerator.

The cabinet 100 may include an upper wall or a roof 110 forming an upper side wall, a lower wall or a bottom 120 forming a lower side wall, two side walls 130 forming opposite side walls, and a rear wall 140, and the cabinet may be configured as a box-shaped body which is opened forward. An inside space of the cabinet 100 may be used as a storage space.

A plurality of partition walls 150 may be provided inside the cabinet 100. The partition walls 150 may divide the storage space in the cabinet 100 into a plurality of spaces, so that the storage space is provided as a plurality of vertically separated storage chambers (1, 2, and 3).

In other implementations, the partition walls 150 may be provided to partition the storage space in the cabinet 100 into storage chambers that are horizontally positioned.

The refrigerator according to an embodiment of the present disclosure is provided with three storage chambers partitioned up and down. An upper storage chamber 1 may be a refrigerator chamber, and a center storage chamber 2 and a lower storage chamber 3 may be a refrigerator chamber or a freezer chamber, or a separate space.

Each of storage chambers (1, 2, and 3) of the cabinet 100 is configured to be separately opened and closed by a door thereof. The upper storage chamber 1 may be opened and closed by a swinging door 4, and the center storage chamber 2 and the lower storage chamber 3 may be opened and closed by the drawer 200. The center storage chamber 2 may be configured to be opened and closed by the swinging door 4.

The swinging door 4 may be hingedly coupled to the cabinet 100 in a swinging manner, and the swinging door 4 may rotate to open or close an opening at the upper storage chamber 1.

A display part 5 (or display) may be provided on a front surface of the swinging door 4 for outputting information. A variety of different information such as an operational state of the refrigerator or temperatures of each storage chamber (1, 2, and 3) may be displayed on the display part 5.

The display part 5 may include at least one of LCD, LED, and so on.

The drawer 200 may open and close in a sliding manner. In an embodiment described below, the drawer 200 may be provided at the lower storage chamber 3 and may open in a drawer manner.

The drawer 200 may include the front panel 210 and a storage bin 220 (or storage room).

The front panel 210 may be pushed into the storage chamber so that the open front of the lower storage chamber 3 is closed and shielded, and the front panel 210 may be an installation space therein.

The front panel 210 may be formed such that a metal thin plate is folded into multiple stages so as to have each wall surface (upper surface, opposite side surfaces, front surface, and lower surface). The front panel 210 may be provided with an inner frame 211 therein. The inner frame 211 may be formed of resin and may be for reducing a weight of the front panel and improving productivity thereof. The front panel 210 may be formed of a material having metal texture.

The storage bin 220 may be provided at a rear of the front panel 210 and is received in the lower storage chamber 3.

The storage bin 220 may be formed in a box-shaped body that is open upward, and a front surface of the storage bin 220 may be fixed to a rear surface of the front panel 210 in a close contact state therewith. The storage bin 220 and the front panel 210 may be coupled to each other by hooking or bolting, screwing, gearing, fitting, and so on.

Guide rails 230 may be respectively provided on opposite outside walls of the storage bin 220 and on opposite inner side walls of the lower storage chamber 3. The inner side walls of the lower storage chamber 3 may face the outer side walls of the storage bin 220. The guide rails of the storage bin 220 and the guide rails of the lower storage chamber 3 are engaged with each other and support forward and rearward movement of the storage bin 220.

Although not shown, the guide rails 230 may be respectively provided on a lower surface of the storage bin 220 and a bottom surface in the lower storage chamber 3, and the guide rails may be engaged with each other, where the bottom surface in the lower storage chamber 3 face the lower surface of the storage bin 220. The guide rails 230 may also be configured to extend into multiple stages.

A separate container 240 may be provided in the storage bin 220. That is, a variety of food may be stored in the storage bin 220, but the container 240 is in the storage bin 220 so that the food may be stored in the container 240. The container 240 may be a kimchi container or a basket to open upward.

When the storage bin 220 is pushed out from the lower storage chamber 3, the container 240 may move upward in the storage bin 220.

In order for a user to raise the container 240 in the storage bin 220, it is necessary to form a gap in which fingers of the user are inserted between the storage bin 220 and the container 240, so a size of the container 240 should be reduced by a size of the gap. Accordingly, the container 240 may be automatically separated from the storage bin 220 in order that the size of the container 240 is maximized. When the container 240 is automatically separated from the storage bin 220, the user can easily take out the container 240.

A raising/lowering module 300 (or lift module) may be provided in the storage bin 220 to automatically raise the container 240.

The raising/lowering module 300 may be embodied in various forms. For example, the raising/lowering module 300 may be formed in a scissors linkage structure such that when the raising/lowering module 300 is folded, a height is minimized, and when the raising/lowering module 300 is unfolded, the height thereof is maximized.

Electrical parts 310 (for example, drive motor, etc.) supplying a driving force for raising movement of the raising/lowering module 300 may be provided in the installation space in the front panel 210.

When the raising/lowering module 300 is operated before the storage bin 220 of the drawer 200 is fully pushed out, the container 240 or the cabinet 100 may be broke. Therefore, a control program may be programmed to operate the raising/lowering module only when the storage bin 220 is fully pushed out (i.e., the drawer is fully opened), and the control program being programmed to control movement of the raising/lowering module 300.

The driving part 400 may provide a driving force for forward and rearward movement of the drawer 200.

The driving part 400 may be provided on the bottom 120 of the cabinet 100, and may include a pinion 410 and a driving motor 420.

The pinion 410 may penetrate partially through the bottom surface (upper surface of the bottom) in the lower storage chamber 3 and may be exposed to the inside of the lower storage chamber 3. The driving motor 420 may supply power to the pinion 410 while being fixed in the bottom 120 of the cabinet 100.

In an embodiment of the present disclosure, two pinions 410 may be respectively provided one by one on opposite sides of the bottom surface in the lower storage chamber 3. The two pinions 410 may be connected to each other by a power transmission shaft 411. The driving motor 420 may be connected to the power transmission shaft 411 by a belt, a chain, or a gear for supplying power thereto.

By the driving of the driving motor 420, the two pinions 410 may rotate at the same time with the same speed and direction.

A reducer (or reduction gear) may be provided in a connecting portion between the power transmission shaft 411 and the driving motor 420.

The two pinions 410 may be positioned at foremost sides of the bottom surface in the lower storage chamber 3. Thus, the drawer may open to the maximum.

The driving motor 420 may operate when proximity of the user is sensed, or may operate when a button 6 is manipulated by the user.

The button 6 may be a touch-type button provided on the display part 5 of the swinging door 4. The button 6 may also be a pressure-type button provided on a separate position from the display part 5.

The cable tray 500 (or cable tray module) of the refrigerator according to an example embodiment of the present disclosure may be described. Other embodiments and configurations may also be provided. The cable tray may also be called a cable support device.

The cable tray 500 may be configured to protect a power line and cables (hereinafter referred to as cables), which are connected to the electrical parts in the front panel 210 among various power lines and cables connected along the inside of the bottom 120.

The cable tray 500 is configured to guide the cables to be moved with forward and rearward movements of the drawer 200, and to prevent the cables from being damaged by twisting and scraping. The cables may be protected by a cable housing.

The cable tray 500 may be configured such that opposite ends of the cable housing are connected to the bottom surface (upper surface of the bottom) in the lower storage chamber 3 and the front panel 210, respectively. The cable tray 500 may include a cover plate 510, a guiding head 520, a plurality of connecting members 530, a swinging connection member 540 (or swinging connection base), and a mounting plate 550.

The cable tray 500 may be described in detail on a per component basis.

The cover plate 510 of the cable tray 500 may be coupled to the upper surface of the bottom 120.

A part of a front upper surface of the bottom 120 may be formed to be open, and the cover plate 510 may be coupled to the bottom 120 and cover the open part thereof.

Two pinion exposure holes 511 may be respectively provided on opposite sides of the cover plate 510 in a penetrating manner so that the pinions 410 of the driving part 400 are exposed.

The cover plate 510 may be provided with a motor receiving part 512 that receives the driving motor 420 (included in the driving part 400). The motor receiving part 512 may protrude upward from a part of the cover plate 510, or may be formed separately from the cover plate 510 and then coupled to the cover plate 510. Although not shown, the motor receiving part 512 may be formed in different forms or manners.

Two protrusion passing holes 513 may be respectively formed through opposite sides in the rear of the cover plate 510, and each protrusion passing holes 513 being for installation of a confining protrusion part 650, which will be described below. An upper end of the confining protrusion part 650 may be exposed toward the inside of the lower storage chamber 3 while the confining protrusion part 650 is accommodated in the protrusion passing hole 513. The confining protrusion part 650 may be described below in a description about a rack gear assembly 600.

An open/close sensing part 514 (or open/close sensing device) may be provided at the inside of the lower storage chamber 3 and the drawer 200 opposed thereto so as to sense opening and closing of the drawer 200. That is, since the open/close sensing part 514 is provided, the user can accurately recognize that the drawer 200 is in a fully closed state or a partially opened state.

The open/close sensing part 514 may include a sensor 514*a* and a sensing member 514*b*. The sensor 514*a* may be a hall sensor, and the sensing member 514*b* may be a magnet that is sensed by the hall sensor. The open/close sensing part 514 may be configured as various structures such as an optical sensor or a switch.

The sensor 514*a* (of the open/close sensing part 514) may be provided at a bottom in the lower storage chamber 3. The sensing member 514*b* may be provided at a lower surface of the storage bin 220 (constituting the drawer 200). Although not shown, the sensing member 514*b* may be provided at the bottom in the lower storage chamber 3 and the sensor 514*a* may be provided at the lower surface of the storage bin 220.

The sensor 514*a* may be provided at the cover plate 510 positioned at the bottom in the lower storage chamber 3, so that maintenance of the sensor 514*a* may be performed by removing the cover plate 510.

A separate sensing member 514*c* may be provided at an end of a bottom surface of the rack gear assembly 600. Accordingly, when the rack gear assembly 600 is fully pushed out, the sensor 514*a* may sense the pushing-out of the rack gear assembly 600, and recognize a fully opened state of the drawer 200.

The guiding head 520 of the cable tray 500 may be coupled to the front panel 210.

An installation hole 212 may be provided on a center lower portion of the rear surface of the front panel 210. The guiding head 520 passes partially into the installation hole 212 and is coupled to the rear surface of the front panel 210.

The cable housing may include a plurality of connecting members. Each of the connecting members 530 (of the cable tray 500) connects the swinging connection member 540 and the guiding head 520 in order to be moveable.

The connecting member 530 may be configured as a hollow tubular body (or cable housing) and may be connected to another connecting member 530 continuously. The cables may pass sequentially inside the connecting members 530 in order. The connection structure of the connecting member 530 may be a chain linkage structure.

A connected portion between each of the connecting members 530 may be provided to swing in a horizontal direction (lateral direction in plan view or bottom view). A first end of the connecting members 530 may be connected to the swinging connection member 540 in a horizontal swinging manner, and a second end of the connecting members 530 may be connected to the guiding head 520 in a horizontal swinging manner. Through the structure, when the drawer 200 is moved forward and rearward, the connecting members 530 may move in conjunction with movement of the drawer 200 to move the cables.

The connecting members 530 may include connecting members 530 at a straight section side S1 of the cable housing and connecting members at a bending section side S2 of the cable housing. In the straight section side S1, connecting members 530 may be sequentially connected to each other and disposed to form a straight line in a moving direction of the drawer 200 from a portion where the connecting members are connected to the drawer 200 (e.g., the guide head) in a view when the drawer 200 is closed. In the bending section side S2, connecting members 530 may be sequentially connected to each other from a portion where the connecting members 530 are connected to the bottom in the lower storage chamber 3 (e.g., rotational connection member) to the connection members at the straight section side S1.

The connecting members 530 at the straight section side S1 form a straight line in the same direction as the moving direction of the drawer 200 when the drawer 200 is not fully closed, but also fully opened. The connecting members 530 at the bending section side S2 are configured such that the connected portion therebetween is deformed from a curved line to a straight line during an opening process of the drawer 200 (e.g., deformed from a straight line into a curved line).

The swinging connection member 540 of the cable tray 500 may be rotatably connected to the cover plate 510.

A cable through-hole 515 may be provided on the cover plate 510 so that the cables pass therethrough. The swinging connection member 540 may have a pipe structure and one end thereof is in close contact with an upper surface of the cover plate 510. On the swinging connection member 540, an extension end 541 may have a dome structure extending gradually toward the end.

An extension hole 516 may be provided at a predetermined position on a circumference of the cable through-hole 515. On a circumference of the extension end 541 constituting the swinging connection member 540, a confining protrusion 542 may protrude outwards and pass through the extension hole 516.

The extension hole 516 may have a width through which only the confining protrusion 542 may pass. That is, as the confining protrusion 542 passes through the extension hole 516 and then a manipulation in which the swinging connection member 540 is partially rotated, the swinging connection member 540 may be maintained in a state of preventing separation from the cable through-hole 515 of the cover plate 510.

The mounting plate 550 of the cable tray 500 may prevent the swinging connection member 540 connected to the cover plate 510 from being separated from the cover plate 510.

The mounting plate 550 may be fixed coupled to the cover plate 510, and provided with a communicating hole 551 and a covering end 552. The communicating hole 551 is provided on a portion corresponding to the cable through-hole 515, and with the covering end 552 protruding from a circumference of the communicating hole 551 to cover the extension end 541 of the swinging connection member 540. An inner surface of the covering end 552 may have the same spherical surface as an outer surface of the extension end 541 so that the covering end 552 and the extension end 541 are in close contact with each other.

According to an embodiment of the present disclosure, considering that the cable tray 500 is positioned between the bottom surface in the lower storage chamber 3 and the lower surface of the storage bin of the drawer 200, the cable tray 500 may drag while contacting the bottom surface in the lower storage chamber 3 by a cable tray's weight.

Accordingly, when the drawer 200 is opened or close, a contact noise may be generated since the cable tray 500 is moved while being dragged in contact with the bottom surface, thus product reliability may decrease.

In an example of the guide head 520 constituting the cable tray 500, since the guide head 520 is connected to a rear surface of the drawer 200 in the horizontal direction, the guide head 520 may be separated from the installation hole 212 formed on the rear surface of the drawer 200 due to sagging of the cable tray 500.

In an embodiment of the present disclosure, a tray guide part 50 (or tray guide device) may be provided to improve sagging and bottom surface contact of the connecting members 530 constituting the cable tray 500. The tray guide part may also be called a guide.

As the tray guide part 50 is provided, the cable tray 500 may be suspended from the lower surface of the storage bin 220 constituting the drawer 200 and may be horizontal so that the cable tray 500 may be prevented from sagging or dragging on the bottom surface of the lower storage chamber 3.

The tray guide part 50 may be provided between opposite surfaces of the cable tray 500 and the drawer 200, and may allow the cable tray 500 to be separated from the bottom surface in the lower storage chamber 3.

In an embodiment of the present disclosure, the tray guide part 50 may include a connection guide 51 and a hook member 52. The connection guide 51 may be provided on the lower surface of the storage bin 220 (of the drawer 200), and the hook member 52 may be provided on an upper surface of at least any one connecting member (among the connecting members 530) and is connected to the connection guide 51.

The connection guide 51 and the hook member 52 may allow the cable tray 500 to be suspended from the lower surface of the storage bin 220 of the drawer 200. Thus, when the drawer 200 is opened and closed, the cable tray 500 is not dragged on the bottom surface of the lower storage chamber 3.

The connection guide 51 and the hook member 52 of the tray guide part 50 may be described in detail.

The connection guide 51 may be spaced from the lower surface of the storage bin 220.

The connection guide 51 may be formed in a bar or a rod structure, and may be disposed such that opposite ends thereof face opposite wall surfaces (opposite wall surfaces of the storage bin) of the drawer 200.

Figure 12:
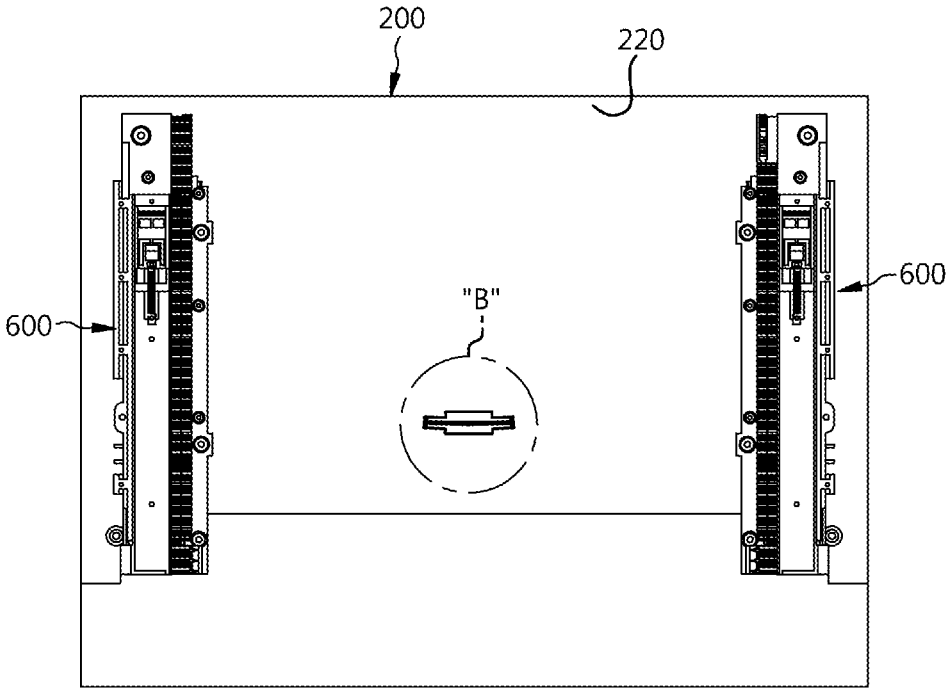
FIG. 12 is a bottom view showing a storage room of the refrigerator according to the embodiment of the present disclosure, wherein rack gear assemblies and a tray guide part are provided at the storage room.

The connection guide 51 may rounded such that the opposite ends thereof are further forward than the center thereof (that is, an upper side direction based on FIG. 12).

That is, when the connection guide 51 is formed in a straight line, the connection guide 51 is difficult to withstand both forward and rearward operating force and leftward and rightward operating force, the forward and rearward operating force being generated by the forward movement of each of the connecting members 530 and the leftward and rightward operating force being generated by bending movement thereof, so that the hook member 52 is not operated smoothly. Therefore, the round structure of the connection guide 51 may be provided to reduce the above-described problem.

Fixing ends 54 may be respectively formed by protruding downward from the lower surface of the storage bin 220 (i.e., at opposite ends of the connection guide 51). As the opposite ends of the connection guide 51 are respectively fixed to the fixing end 54, the connection guide 51 may be maintained in a state of being spaced from the lower surface of the storage bin 220.

On a bottom of the storage bin 220, a guide exposure hole 221 is provided to expose at least a portion of the connection guide 51.

Through the guide exposure hole 221, the user can check that the cable tray 500 is precisely suspended from the connection guide 51 without taking out the drawer 200.

The guide exposure hole 221 may expose the entire portion of the connection guide 51, so the user can recognize whether the cable tray 500 is suspended from the connection guide 51.

Figure 13:
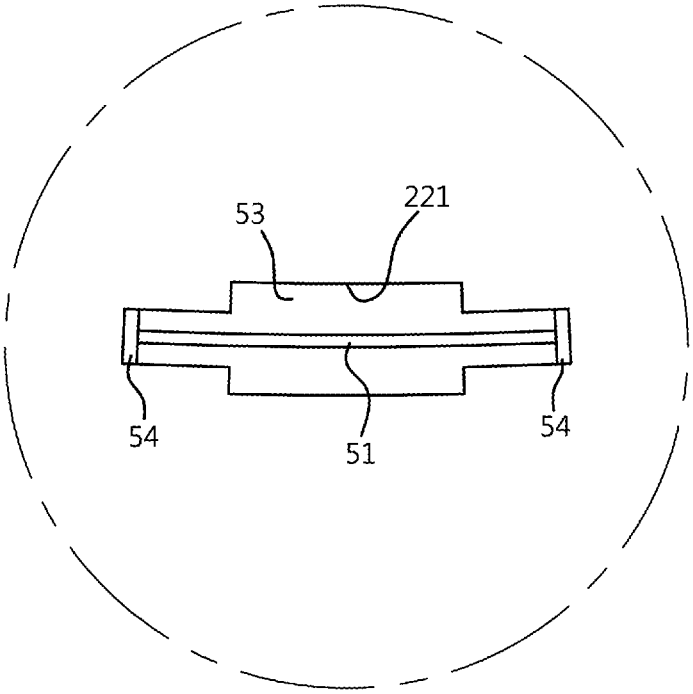
FIG. 13 is an enlarged view of "B" part in FIG. 12.
Figure 14:
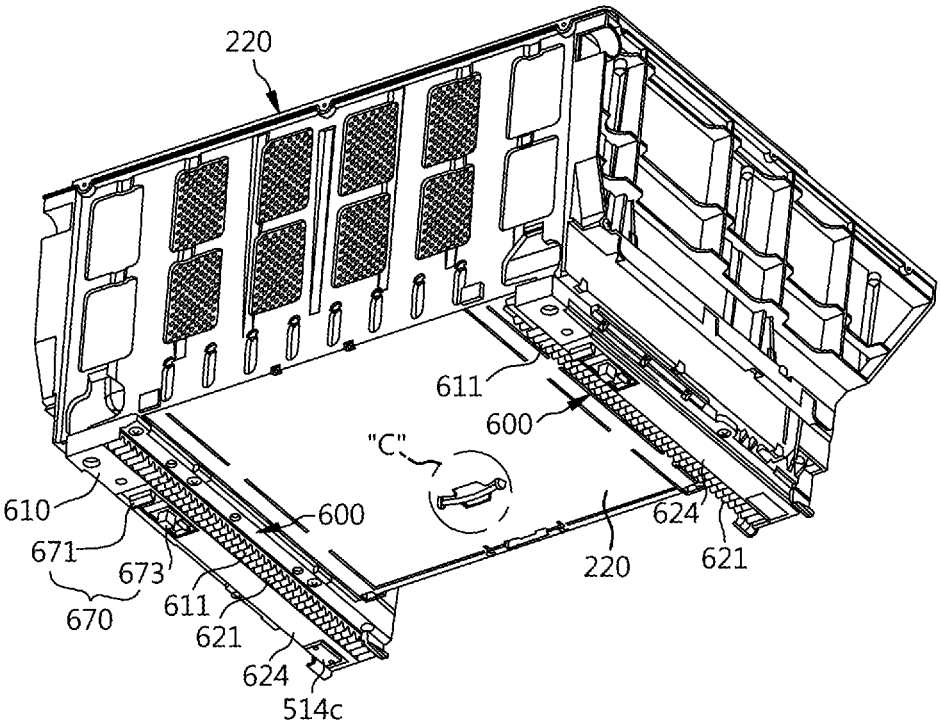
FIG. 14 is a perspective view showing the storage room at the bottom, wherein the rack gear assemblies and the tray guide part are provided in the storage room.
Figure 15:
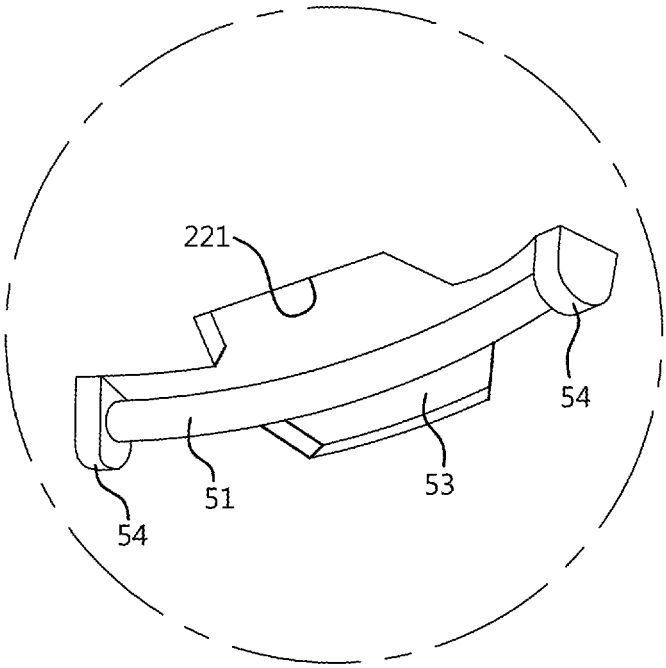
FIG. 15 is an enlarged view of "C" part in FIG. 14.
Figure 16:
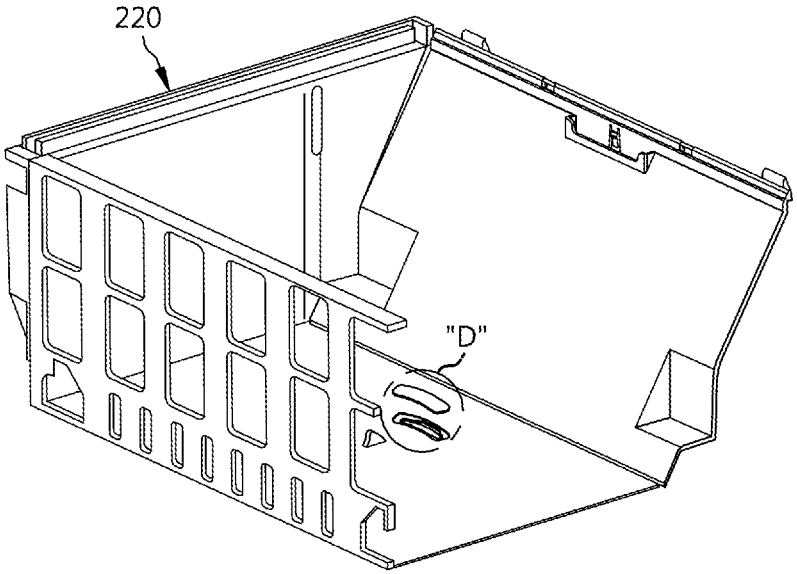
FIG. 16 is a perspective view showing the storage room of the refrigerator according to the present disclosure, a part of walls of the storage room is cut for showing a guide exposure hole provided in the storage room.
Figure 17:
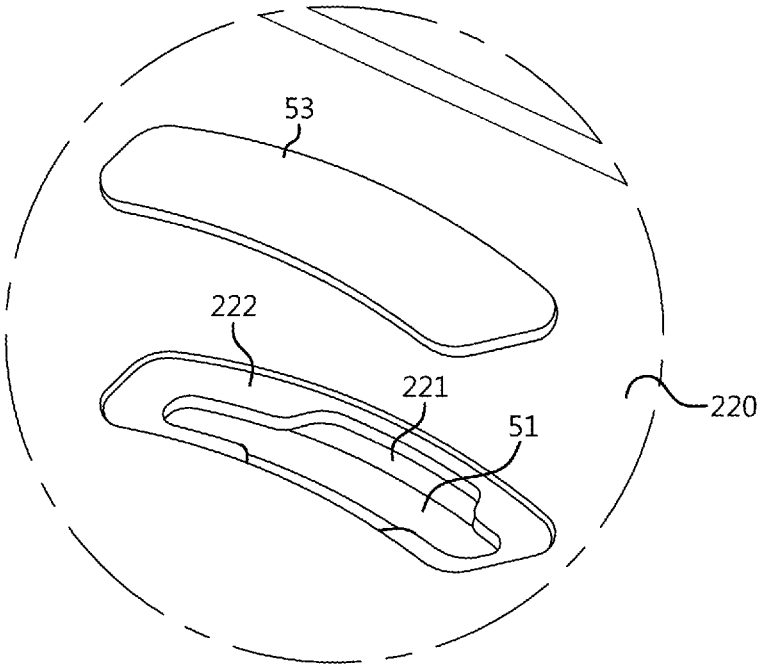
FIG. 17 is an enlarged view of "D" part in FIG. 16.
Figure 18:
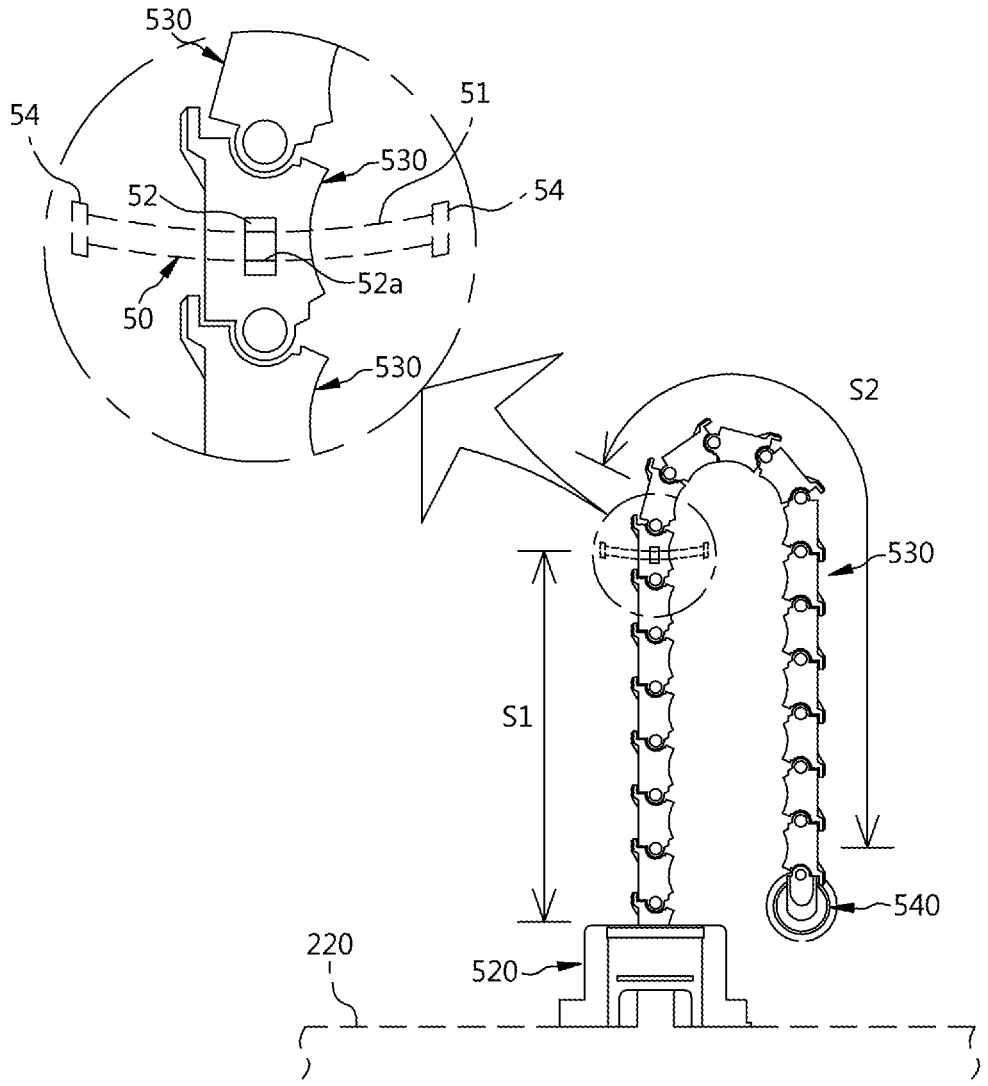
FIGS. 18 and 19 are plan views showing operational states of the tray guide part of the refrigerator according to the embodiment of the present disclosure.
Figure 19:
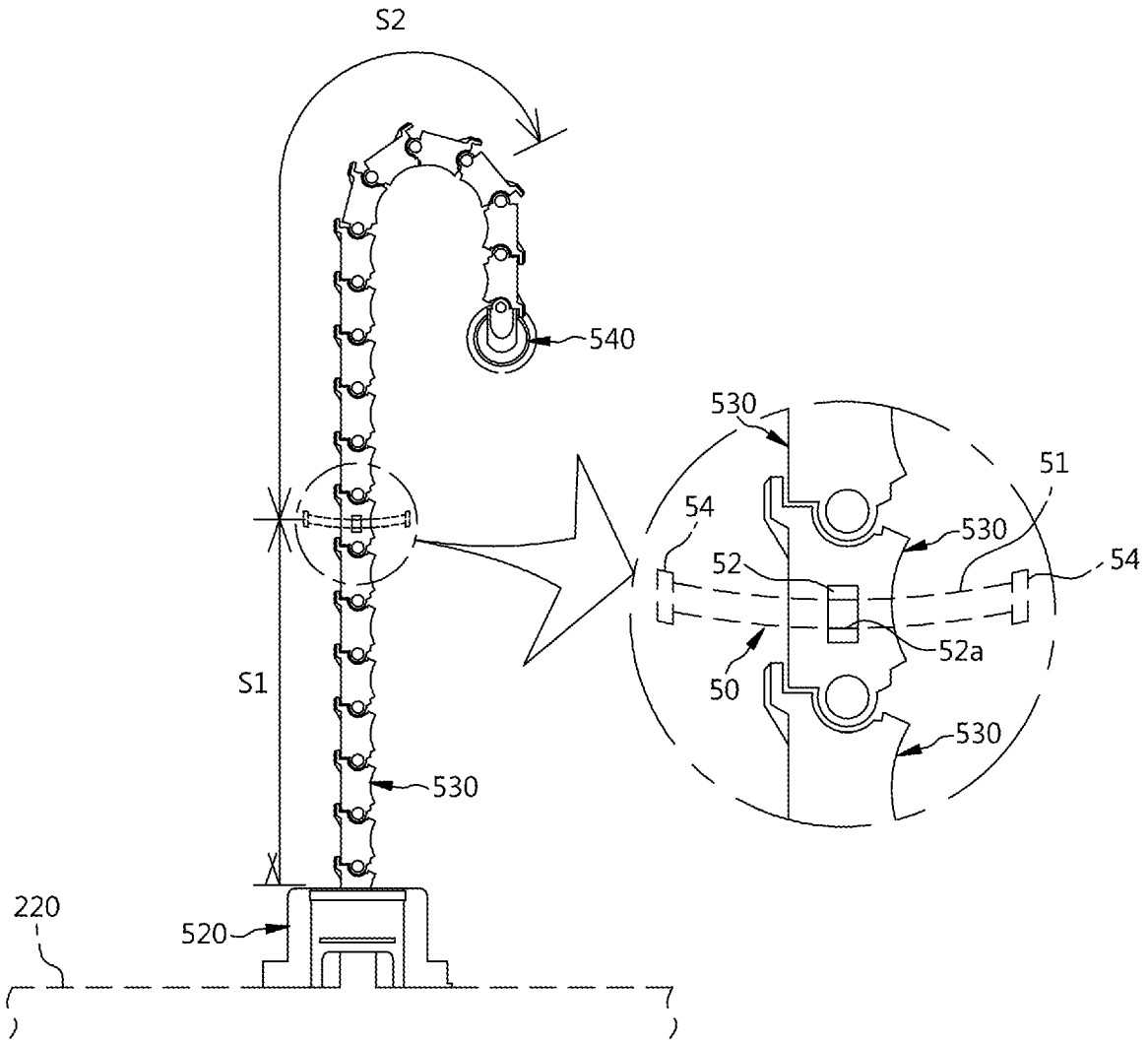

The guide exposure hole 221 may be configured such that a center portion thereof is open larger than the other portions thereof (referring to FIGS. 13 and 15). Through the structure, when the cable tray 500 is separated from the connection guide 51, the cable tray 500 may be connected to the connection guide 51 through the guide exposure hole 221 without separating the drawer 200.

When the guide exposure hole 221 is formed by penetrating the bottom of the storage bin 220, cold air and foreign materials may enter the storage bin through the open portion. When water is in the storage bin 220, water may be drained to the bottom in the lower storage chamber 3 through the guide exposure hole 221 during opening of the drawer 200.

Accordingly, in an embodiment of the present disclosure, a shielding cover 53 may be provided on a bottom surface in the storage bin 220 for shielding the guide exposure hole 221.

On the bottom surface in the storage bin 220, a cover seating groove 222 is formed in a step shape around a circumference of the guide exposure hole 221. As the shielding cover 53 is seated in the cover seating groove 222, the shielding cover 53 may be prevented from being inadvertently peeled off by hitting storage items in the storage room. This may be shown in FIGS. 16 and 17.

The hook member 52 of the tray guide part 50 may allow the cable tray 500 to be suspended from the connection guide 51.

The hook member 52 may be provided at any one connecting member among the connecting members 530 at the straight section side S1. That is, the connecting members 530 at the straight section side S1 may move only in the front and rear directions regardless of opening or closing of the drawer 200, so that the connecting members 530 at the straight section side S1 may be maintained in a suspended state from the connection guide 51 provided on the lower surface of the storage bin 220. This may be shown in FIGS. 18 and 19.

The hook member 52 may protrude from an upper surface of the connecting member 530. Although as not shown, the hook member 52 may be formed separately from the connecting member 530 and then fixed to (e.g., coupled to) the connecting member 530 to be integrated therewith.

The hook member 52 may be provided at one connecting member 530 positioned at a rear end of the connecting members 530 at the straight section side S1, and the connection guide 51 may be positioned at a portion of the lower surface of the storage bin 220, the portion facing the hook member 52, and connected to the hook member 52. Since a connection portion between the connecting members 530 at the straight section side S1 and the connecting members 530 at the bending section side S2 is far from supporting portions of the opposite ends of the connecting members, the connection portion may substantially sag downward. Therefore, the connection portion is suspended from the connection guide 51 to prevent the sagging of the connecting member 530 maximally.

The hook member 52 may be provided with a hook groove 52*a* on an upper surface thereof, and the connection guide 51 may be inserted into the hook groove 52*a* to allow the hook member 52 to be suspended from the connection guide 51.

The hook groove 52*a* may formed on the upper surface of the hook member 52 and open upward, and a width of the open portion of the hook groove on the upper surface of the hook member 52 may be formed narrower than a width of an inside portion of the hook groove 52*a*. Accordingly, the connection guide 51 may be prevented from being removed from the hook groove 52*a* when the connection guide 51 is inserted in the hook groove 52*a*. The connection guide 51 may have larger diameter than the width of the open portion of the hook groove 52*a*, and may have a diameter smaller than or equal to the width of the inside portion of the hook groove 52*a*.

The hook member 52 may be configured to be moveable along a longitudinal direction of the connection guide 51. That is, the connection portion between the connecting members 530 may be formed to be swingable and may be partially bent from side to side when the drawer 200 is moved forward and rearward. Thus, the connection guide 51 may be formed in a transversely long structure (specifically, round structure) and the hook member 52 may be formed to be moveable in the longitudinal direction of the connection guide 51.

The rack gear assembly 600 of the refrigerator according to an embodiment of the present disclosure may be described.

The rack gear assembly 600 may operate so that the drawer 200 is moved forward and rearward by a driving force of the driving part 400 provided in the cabinet 100.

Two rack gear assemblies 600 are respectively provided on opposite sides of the lower surface of the storage bin 220 constituting the drawer 200. As the rack gear assemblies 600 have respectively rack gears 611 and 621 on lower surfaces thereof, the rack gear assemblies 600 are installed to be engaged with the pinions 410 that are exposed to the inside of the lower storage chamber 3.

The rack gears 611 and 621 (of the rack gear assembly 600) are formed by extending from a front side of the lower surface of the storage bin 220 to a rear side thereof. Thus, the drawer 200 provided with the rack gear assemblies 600 may move forward and rearward from the lower storage chamber 3 while being moved forward and rearward by rotation movement of the pinions 410.

The pinions 410 and the rack gear assemblies 600 may be respectively made in pairs of at least three pinions and at least three rack gear assemblies.

As an automatic pushing-out distance of the storage bin 220 is increased, usability of the drawer 200 may improve.

That is, as a storage space in the storage bin 220 is maximally moved in the opposite direction from the lower storage chamber 3, the drawer 200 may be provided such that it is easy to store the container 240 in the storage bin 220, or to store items and food in the storage space.

The container 240 may be automatically raised by the raising/lowering module 300 when the drawer 200 is opened. Thus, the storage bin 220 may be maximally separated from the lower storage chamber 3.

The two pinions 410 may be positioned on a portion of the front side of the lower storage chamber 3, and lengths of the rack gears 611 and 621 may be maximally long.

That is, as the two pinions 410 are positioned close to a portion of the front side of the lower storage chamber 3 and the rack gears 611 and 621 have the long lengths, the pushing-out distance of the storage bin 220 may increase.

A front to rear length of the lower surface of the storage bin 220 may be formed shorter than that of an open upper surface of the storage bin 220. In view of that, the rack gears 611 and 621 may have limited lengths.

Accordingly, the rack gear assemblies 600 according to an embodiment are configured to extend in lengths thereof, thereby increasing the pushing-out distance of the storage bin 220.

That is, even when the front to rear length of the storage bin 220 is short, lengths of the rack gear assemblies 600 extend, thereby allowing the storage bin 220 to be farther pushed out.

Therefore, in an embodiment of the present disclosure, each of the rack gear assemblies 600 includes a first rack member 610 and a second rack member 620, a first rack cover 614, a second rack cover 624, a confining protrusion part 650, and a confining module 670 that are pushed out while being moved forward in order.

Figure 20:
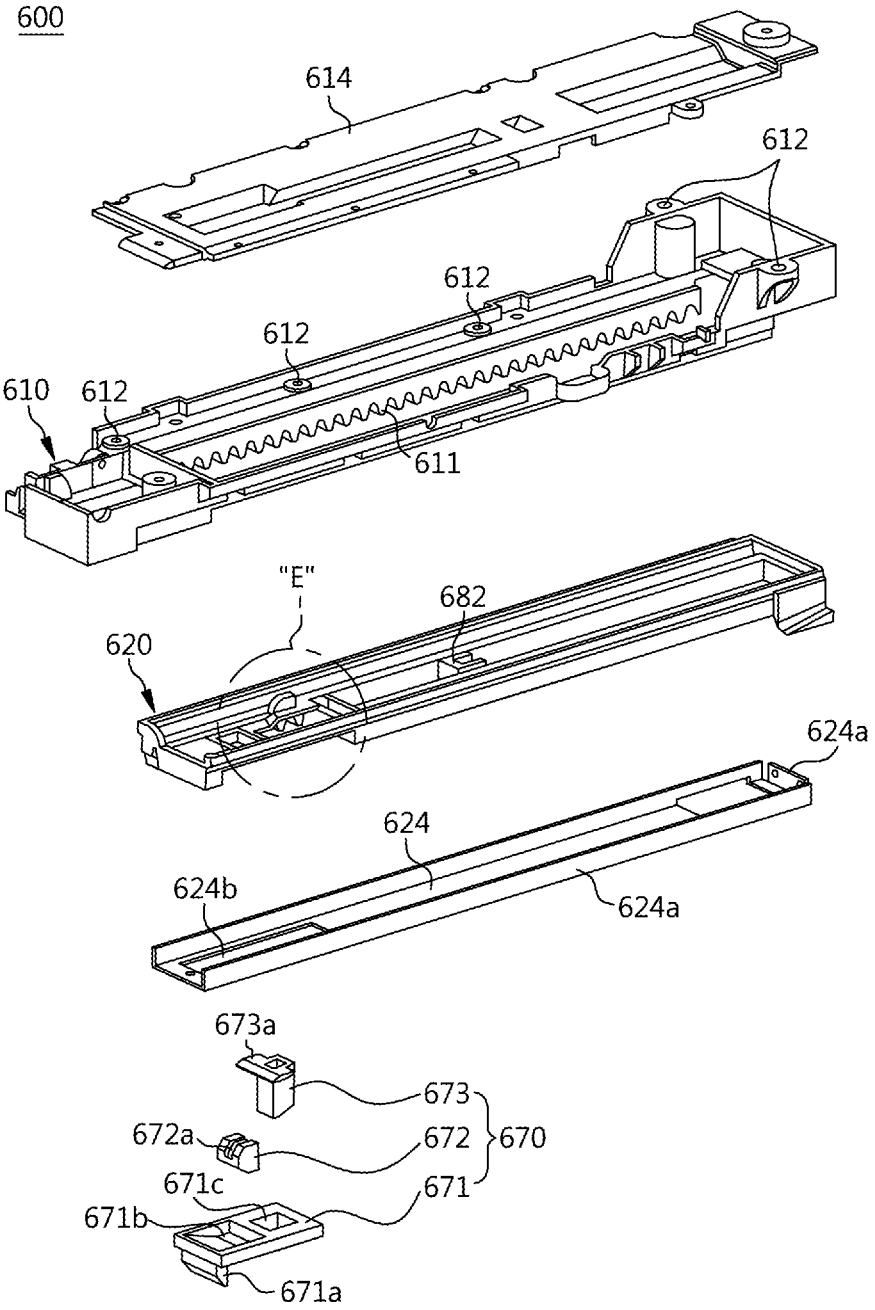
FIG. 20 is an exploded-perspective view showing each of the rack gear assemblies according to the embodiment of the present disclosure, the view being taken at an upper side of the rack gear assembly.
Figure 21:
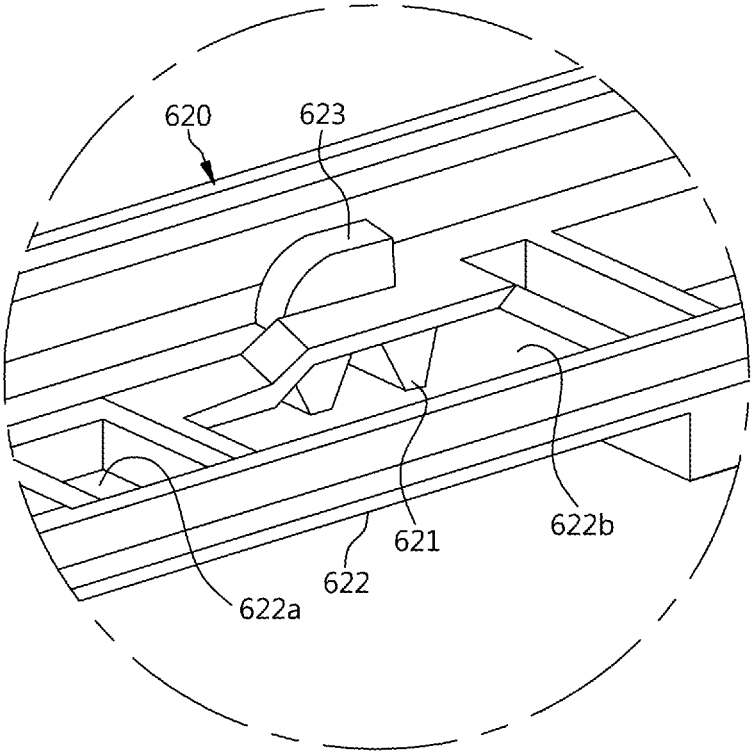
FIG. 21 is an enlarged view of "E" part in FIG. 20.
Figure 22:
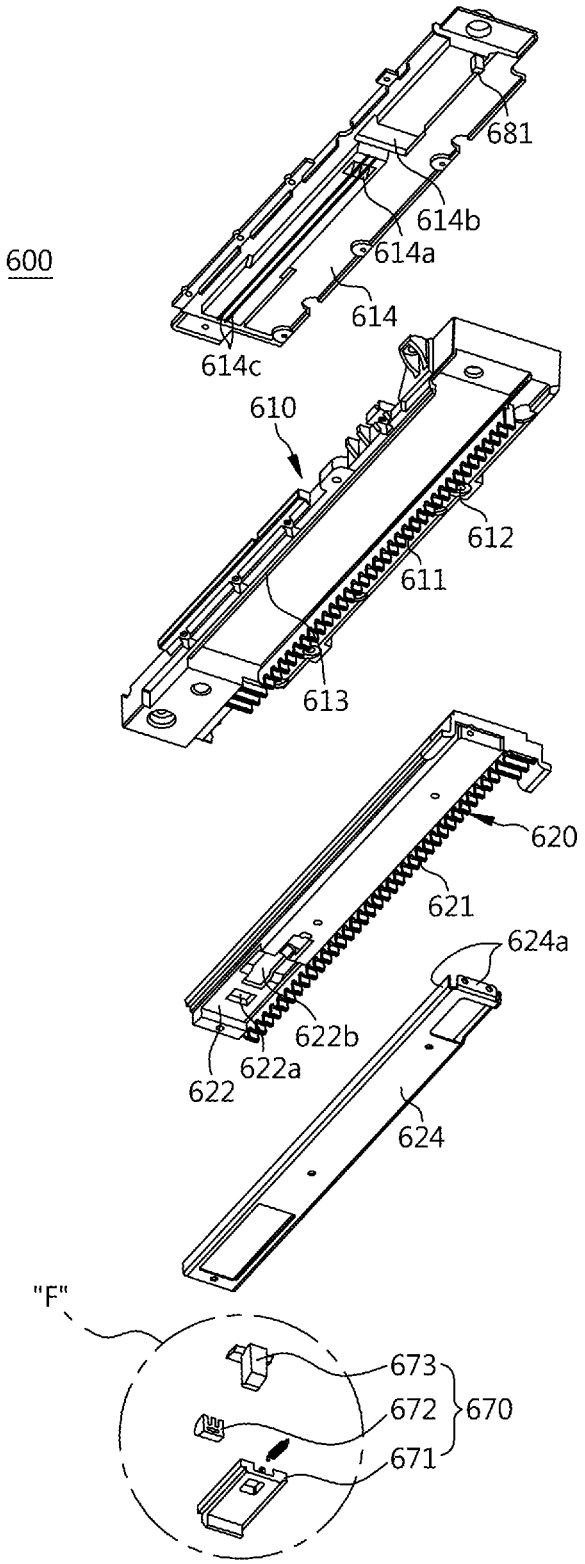
FIG. 22 is an exploded-perspective view showing the rack gear assembly according to the embodiment of the present disclosure, the view being taken at the lower side thereof.
Figure 23:
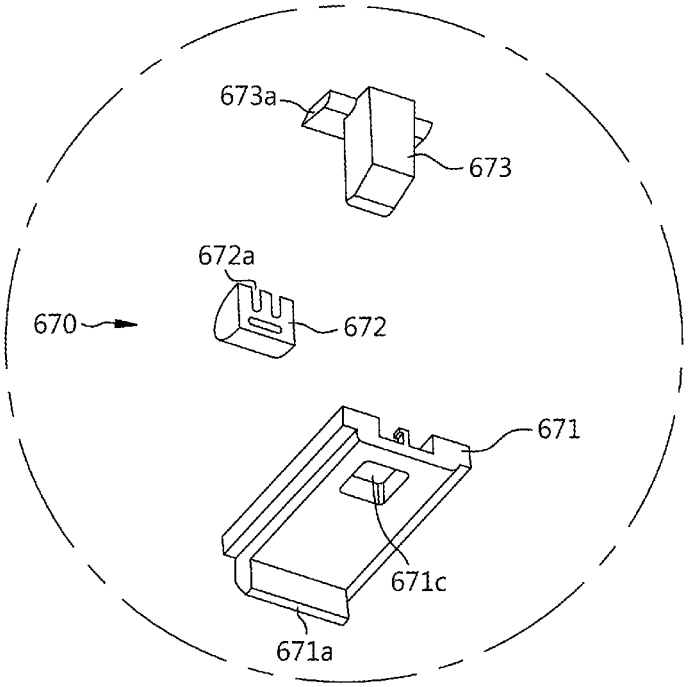
FIG. 23 is an enlarged view of "F" part in FIG. 22.
Figure 24:
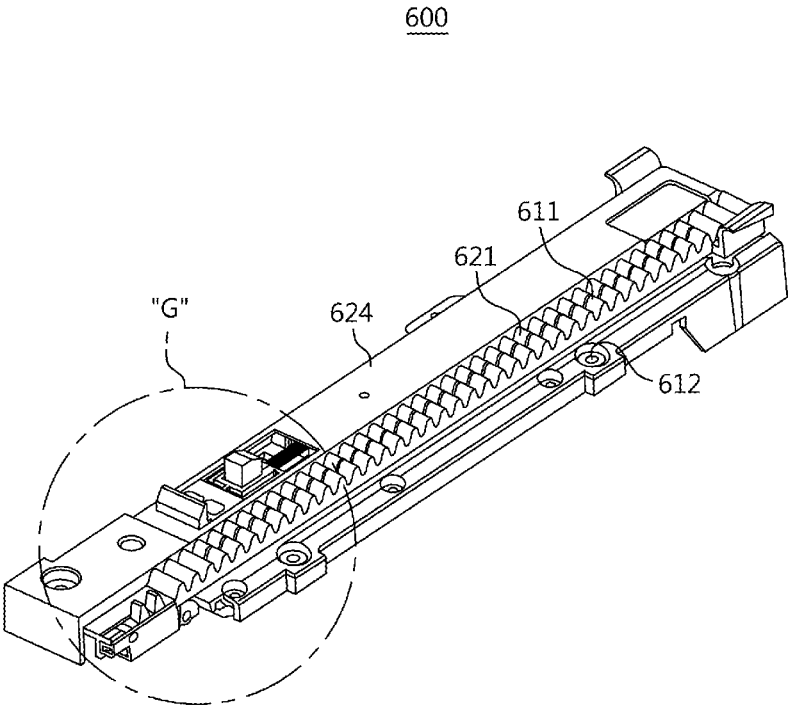
FIG. 24 is a perspective view showing the rack gear assembly of the refrigerator according to the embodiment of the present disclosure, the rack gear assembly being overturned for showing a lower surface structure thereof.
Figure 25:
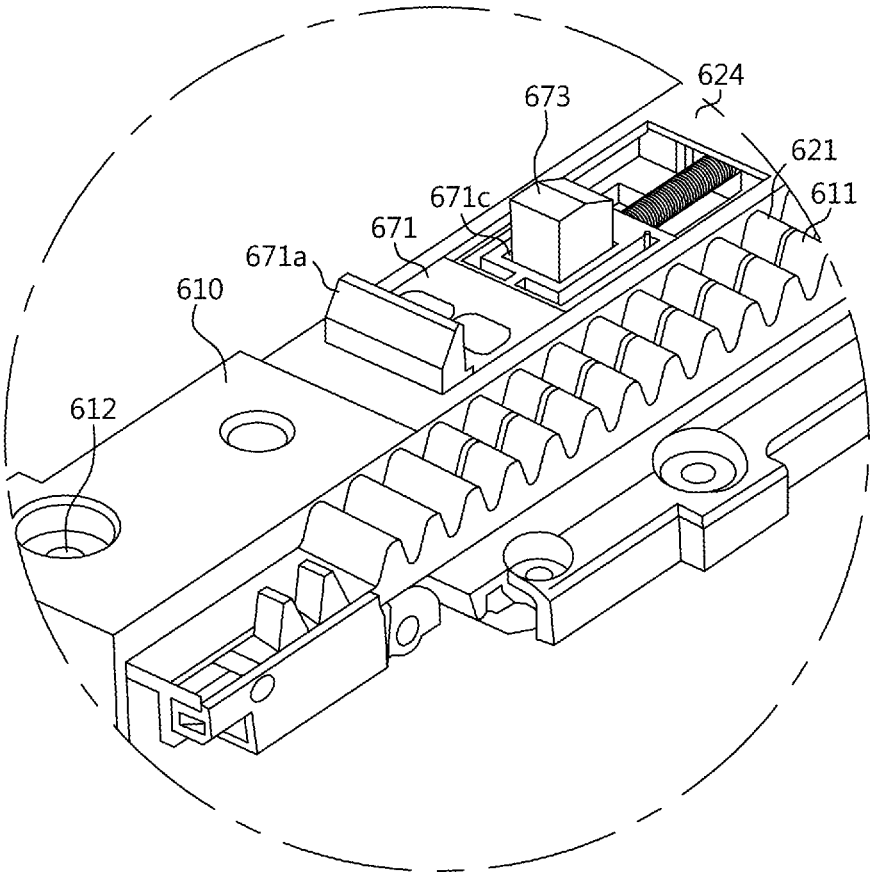
FIG. 25 is an enlarged view of "G" part in FIG. 24.
Figure 26:
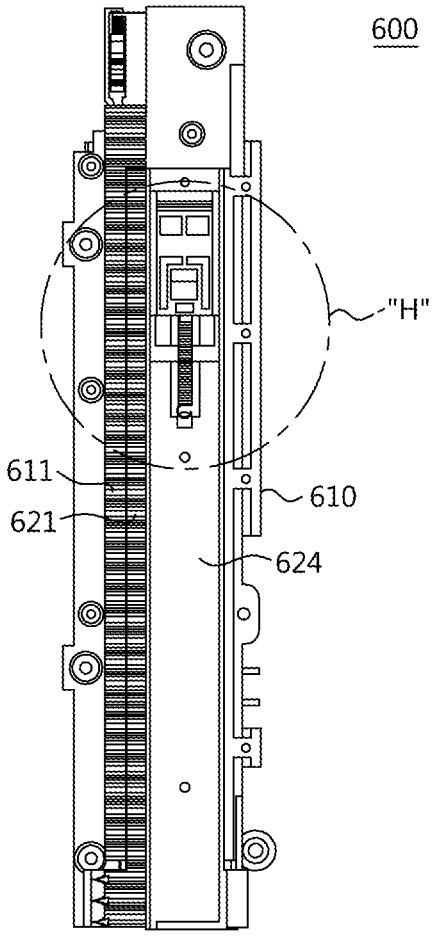
FIG. 26 is a bottom view showing the lower surface structure of the rack gear assembly of the refrigerator according to the embodiment of the present disclosure.
Figure 27:
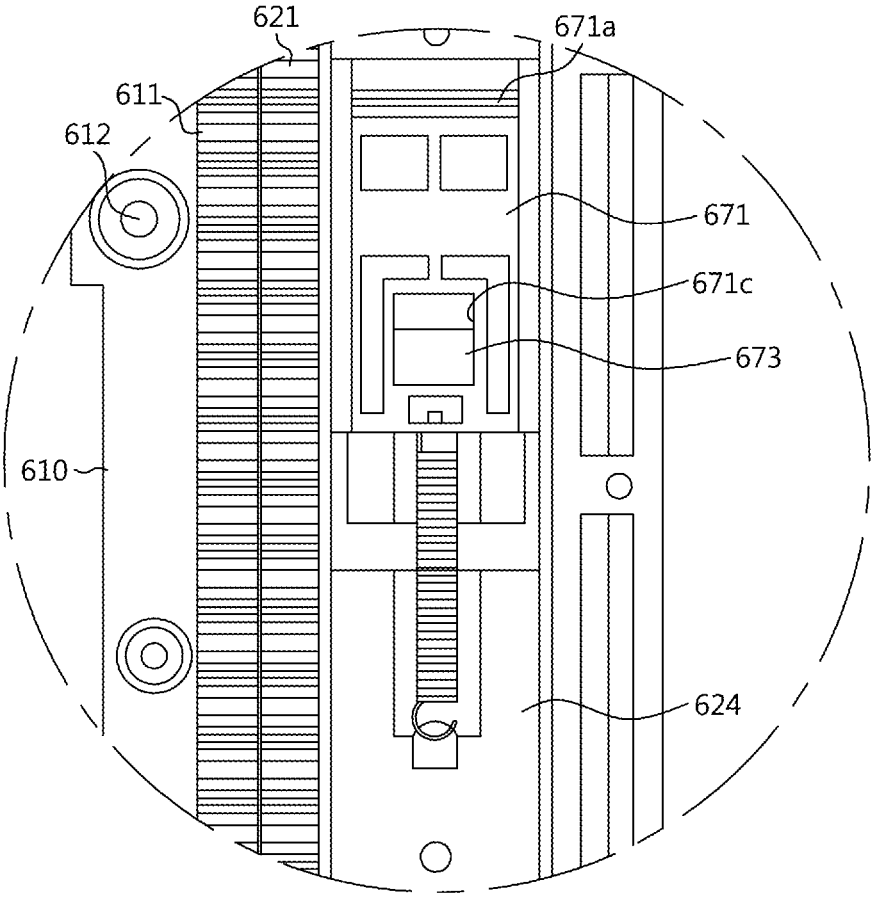
FIG. 27 is an enlarged view of "H" part in FIG. 26.

The rack gear assembly 600 may be described in detail by each part as follows with reference to FIGS. 20 to 28. FIG. 20 is an exploded-perspective view showing each of the rack gear assemblies according to the embodiment of the present disclosure, the view being taken at an upper side of the rack gear assembly. FIG. 21 is an enlarged view of "E" part in FIG. 20. FIG. 22 is an exploded-perspective view showing the rack gear assembly according to the embodiment of the present disclosure, the view being taken at the lower portion thereof. FIG. 23 is an enlarged view of "F" part in FIG. 22. FIG. 24 is a perspective view showing the rack gear assembly of the refrigerator according to the embodiment of the present disclosure, the rack gear assembly being overturned for showing a bottom side structure thereof. FIG. 25 is an enlarged view of "G" part in FIG. 24. FIG. 26 is a bottom view showing the bottom side structure of the rack gear assembly of the refrigerator according to the embodiment of the present disclosure. FIG. 27 is an enlarged view of "H" part in FIG. 26.

The first rack member 610 may perform forward and rearward movement of the storage bin 220 by rotation of the pinion 410, and the first rack member may have a rack gear 611.

The first rack member 610 may be provided such that an upper surface thereof is fixed to the lower surface of the storage bin 220 while being in close contact thereto. A plurality of coupling holes 612 may be provided on the first rack member 610, and the first rack member 610 may be attached to the storage bin 220 by screw fastening through the coupling holes 612.

The second rack member 620 may be at a lower surface of the first rack member 610, and thus the first rack member 610 may have a movement guiding groove 613 that is formed in the depressed manner and supports sliding movement of the second rack member 620.

The movement guiding groove 613 may be provided in a depressed manner from a front end portion of the first rack member 610 and formed by penetrating through a rear surface of the first rack member 610. That is, the second rack member 620 received at the movement guiding groove 613 may be exposed to the rear of the movement guiding groove 613.

The rack gear 611 of the first rack member 610 may be provided on any one side (one side in the opposite direction between two rack gear assemblies) of the movement guiding groove 613 along a longitudinal direction of the first rack member 610 in which the rack gear 611 is included.

The rack gear 611 may be further forward than the movement guiding groove 613.

The first rack member 610 may include a first rack cover 614.

The movement guiding groove 613 provided in the first rack member 610 has an inside portion that is open vertically so that a holder 672 and a locking member 673, which are included in the confining module 670, may pass through the movement guiding groove 613. The first rack cover 614 covers the upper surface of the first rack member 610 by being coupled thereto, so that a lower surface of the first rack cover 614 covers an open portion of the movement guiding groove 613 provided on the first rack member 610 and is provided as an upper surface in the movement guiding groove 613.

The first rack cover 614 may be formed of a metal plate to reinforce insufficient strength of the first rack member 610.

The lower surface (upper surface in the movement guiding groove) of the first rack cover 614 may include receiving grooves 614*a* and 614*b* in which the holder 672 and the locking member 673 of the confining module 670 are respectively received (referring to FIG. 22).

The receiving grooves 614*a* and 614*b* include a first receiving groove 614*a* for receiving the holder 672 and a second receiving groove 614*b* for receiving the locking member 673. The two receiving grooves 614*a* and 614*b* are spaced apart from each other in a moving direction of the first rack member 610. A spaced distance between a rear surface of the first receiving groove 614*a* and a rear surface of the second receiving groove 614*b* may be longer than a spaced distance between a rear surface of the holder 672 and a rear surface of the locking member 673.

The receiving grooves 614*a* and 614*b* are configured such that the holder 672 is firstly received into the first receiving groove 614*a* and then the locking member 673 is received into the second receiving groove 614*b*.

Unlike the above-described embodiment, the first rack cover 614 and the first rack member 610 may be provided as a single body through an injection molding manner.

However, when the first rack member 610 and the first rack cover 614 are configured as the single body, it is difficult for the injection molding thereof. That is, the first rack member 610 and the first rack cover 614 are different in shapes and directions at uneven portions thereof, so that the injection molding thereof is difficult.

Accordingly, as shown in the embodiment, the first rack member 610 and the first rack cover 614 may be separately manufactured and then coupled to each other.

The second rack member 620 may perform the forward and rearward movement of the storage bin 220 together with the first rack member 610.

The second rack member 620 is inserted in the movement guiding groove 613 of the first rack member 610. When the first rack member 610 is moved by a preset distance, the second rack member 620 is moved forward by leading of the first rack member 610 and receives the rotational force of the pinion 410. As the second rack member 620 is continuously moved forward by rotational force of the pinion 410, the first rack member 610 is further pushed out even when the rack gear 611 of the first rack member 610 is separated from the pinion 410.

The first rack member 610 may lead the second rack member 620 through a linkage part 680 so that the second rack member 620 is moved.

The linkage part 680 may include a linkage protrusion 681 (referring to FIG. 17) and a linkage step 682 (referring to FIG. 15), where the linkage protrusion 681 is provided on the lower surface (lower surface in the movement guiding groove) of the first rack cover 614 and the linkage step 682 is provided on an upper surface of the second rack member 620. When the first rack member 610 is moved forward by the preset distance, the linkage protrusion 681 and the linkage step 682 are in contact with each other to perform forward movement of the second rack member 620. The linked movement by the linkage part 680 may be shown in FIGS. 29 and 31.

Although not shown, the linkage protrusion 681 may be provided on the first rack member 610. Although not shown, the linkage protrusion 681 may be provided on the upper surface of the second rack member 620 and the linkage step 682 may be provided on a lower surface of the first rack member 610.

When the second rack member 620 is fully inserted into the movement guiding groove 613 of the first rack member 610, a spaced distance between the linkage protrusion 681 and the linkage step 682 is configured as a distance that is set such that the first rack member 610 is moved forward without affecting the second rack member 620. The preset distance may be determined based on a size or a total pushing-out distance of the storage bin 220.

The second rack member 620 may be provided with a rack gear 621. The rack gear 621 is formed alongside a side portion of the rack gear 611 of the first rack member 610. A front end of the rack gear 621 is provided to be further rearward than a front end of the rack gear 611 of the first rack member 610, and a rear side end thereof is provided to further extend to the rear side than a rear side end of the rack gear 611 of the first rack member 610.

The rack gears 611 and 621 of the first rack member 610 and the second rack member 620 may easily receive the driving force of the pinions 410, respectively. That is, since the pinions 410 are formed to have the width that is a size of adding a width of the rack gear 611 of the first rack member 610 and the rack gear 621 of the second rack member 620, each of the rack gears 611 and 621 may efficiently receive the driving force of the pinions 410.

A motion groove 622 may be provided on a front lower surface of the second rack member 620 in the depressed manner. The motion groove 622 may provide a motion space in which a stopper member 671 of the confining module 670 is moved forward and rearward in a mounted state.

The motion groove 622 may be provided with a plurality of through holes 622*a* and 622*b* in an upward penetrating manner. The through holes 622*a* and 622*b* may include a first through hole 622*a* through which the holder 672 passes and a second through hole 622*b* through which the locking member 673 passes. The holder 672 and the locking member 673 are included in the confining module 670 and may be described below.

The second through hole 622*b* may be a horizontally long hole so that it is possible that forward and rearward movement of the locking member 673 may be performed.

A second rack cover 624 may be provided at a lower surface of the second rack member 620. The second rack cover 624 may cover the lower surface of the second rack member 620.

The second rack cover 624 may prevent the stopper member 671, mounted to the motion groove 622 of the second rack member 620, from being separated to the outside.

The second rack cover 624 may be formed of a metal plate and may cover the lower surface of the second rack member 620. Thus, deformation such as torsion or bending of the second rack member 620 may be prevented. The second rack cover 624 may be provided with a partially open portion for reducing the weight thereof.

The second rack cover 624 may be provided with folded ends 624*a* in a folded manner on opposite side surfaces and a rear surface thereof. The folded ends 624*a* cover parts of the opposite side surfaces and the rear surfaces of the second rack member 620 to prevent flexural deformation of the second rack member 620.

The second rack cover 624 may include an exposure hole 624*b* on a front end portion thereof, and the stopper member 671 may be partially exposed through the exposure hole 624*b*.

The separate sensing member 514*c* may be provided at a rear end of a bottom surface of a second rack member 620, the second rack member 620 being included in any one rack gear assembly 600 among the two rack gear assemblies 600 at opposite sides of the lower surface of the storage bin 220. The separate sensing member 514*c* may be used to recognize the full opening of the drawer.

The confining module 670 may confine the second rack member 620 until the first rack member 610 is fully pushed out.

The confining protrusion part 650 may be a single body in which an upper surface is close and a lower surface is open, and the confining protrusion part 650 is provided on a front upper surface (bottom surface in storage chamber) of the bottom 120 constituting the cabinet 100.

Figure 28:
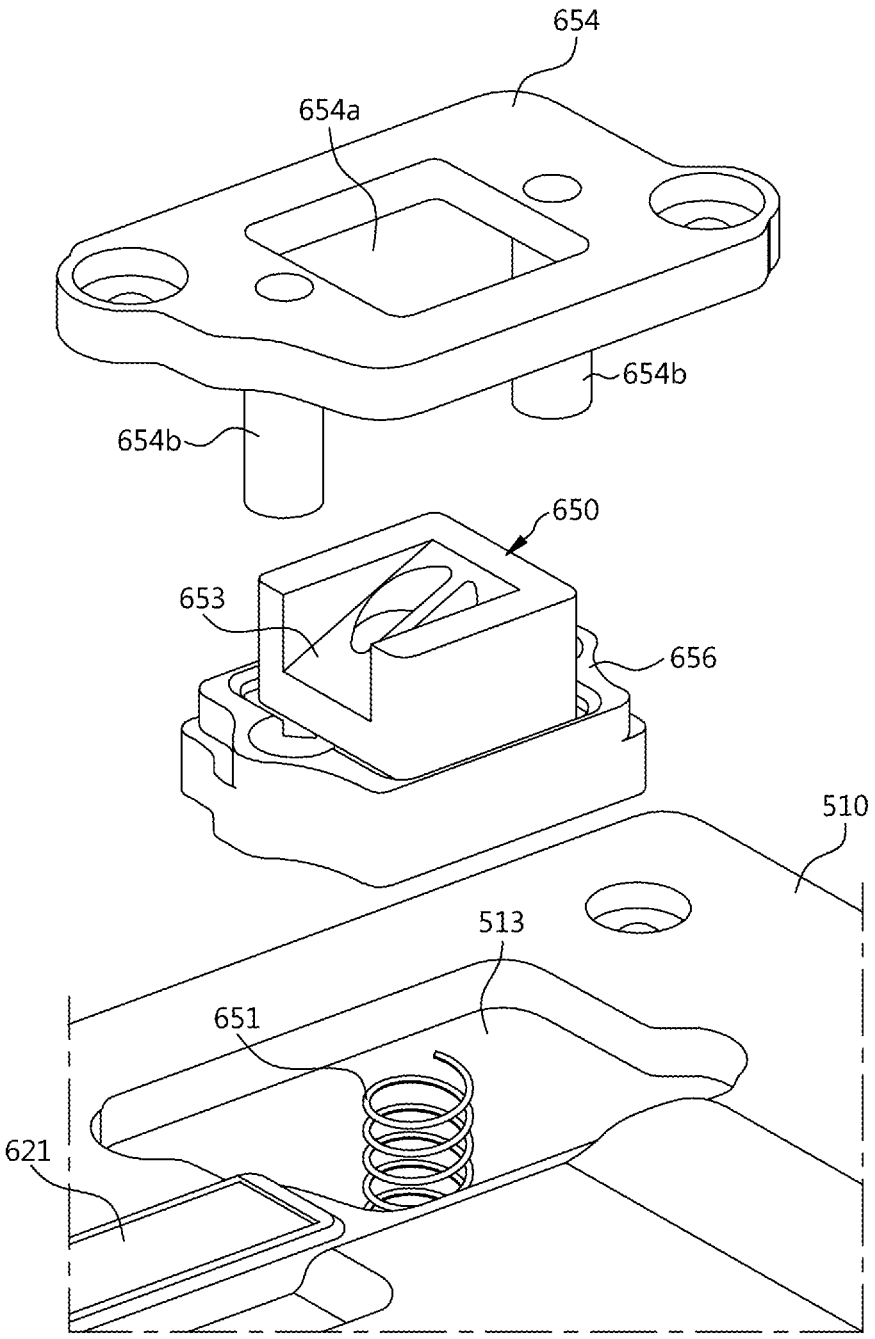
FIG. 28 is a main part perspective view showing an installation structure of a confining protrusion part of the refrigerator according to the embodiment of the present disclosure.

The confining protrusion part 650 may be inserted in the protrusion passing hole 513 formed through the cover plate 510 as shown in FIG. 28. When the cover plate 510 is not provided, the protrusion passing hole 513 is formed through the bottom surface (bottom surface in storage chamber) in the cabinet 100, and the confining protrusion part 650 may be installed therein.

An inner width of the protrusion passing hole 513 may be formed to be larger than an outer width of the confining protrusion part 650. The confining holder 654 is provided to block the outward exposure of a gap that is caused by width difference between the protrusion passing hole 513 and the confining protrusion part 650.

The confining holder 654 may be coupled to the upper surface of the cover plate 510 (e.g., upper surface of bottom). A protrusion through hole 654*a* through which the confining protrusion part 650 passes may be provided on a center portion of the confining holder 654. A circumference portion of the confining holder 654 may block the gap between the protrusion passing hole 513 and the confining protrusion part 650, and may be coupled to the cover plate 510.

A coupling end 656 may protrude outwards from a circumferential surface of the confining protrusion part 650, and a raising guide 654*b* may protrude from a bottom surface of the confining holder 654 and passes through the coupling end 656 from the top to the bottom. The coupling ends 656 may be respectively formed by protruding from opposite sides of the confining protrusion part 650, and the raising guides 654*b* are respectively provided on opposite sides of the confining holder 654 and pass through the coupling ends 656, respectively.

The raising guide 654*b* may support up and down movement of the confining protrusion part 650.

The confining protrusion part 650 may be elastically moved up and down in the protrusion passing hole 513 by an elastic member 651.

When pressure is applied to the confining protrusion part 650, the confining protrusion part 650 is moved downward into the protrusion passing hole 513, and when the confining protrusion part 650 is not under pressure, the confining protrusion part 650 is moved upward from the protrusion passing hole 513 so that a part thereof is exposed (protrude) to the inside of the lower storage chamber 3.

The elastic member 651 may be a coil spring, and a spring engagement protrusion 652 may protrude downward from the inside of the confining protrusion part 650. The elastic member 651 is configured such that an upper end thereof passes through a lower surface of the confining protrusion part 650 and is engaged with the spring engagement protrusion 652 of the confining protrusion part 650.

The confining protrusion part 650 is at a rear of the pinion 410, and is provided to be as close as possible to the pinion 410.

At a center portion of an upper surface of the confining protrusion part 650, a slope 653 is inclined upward such that the front is low and the rear is high. As the locking member 673 of the confining module 670 is moved backward along the slope 653, the confining protrusion part 650 is moved backward.

The confining module 670 may confine the second rack member 620 before the first rack member 610 is fully pushed out.

The confining module 670 may include a stopper member 671, a holder 672, and a locking member 673.

The stopper member 671 may be installed in the motion groove 622 of the second rack member 620, and may function to restrict the rearward movement of the second rack member 620. A length (from the front to the rear) of the stopper member 671 is shorter than a length (from the front to the rear) of the motion groove 622, so that the stopper member 671 is installed to be moveable in forward and rearward directions within the motion groove 622.

The stopper member 671 may include a confining hook 671*a* at a lower surface of a front end thereof. The confining hook 671*a* may protrude downward. When the drawer 200 is closed to enter the preset distance, the confining hook 671*a* is hit a front surface of the confining protrusion part 650 to prevent the stopper member 671 and the first rack member 610 from being moved backward.

A holder groove 671*b* may be provided on a front upper surface of the stopper member 671, and a locking member through hole 671*c* may be provided on a rear side portion of the stopper member 671.

The holder groove 671*b* may be gradually inclined downward such that the front is high and the rear is low. Therefore, when the holder 672 received inside the holder groove 671*b* is moved forward, the holder 672 may be easily separated from the holder groove 671*b*.

The holder 672 is provided to restrict the forward and rearward movement of the stopper member 671.

A lower end of the holder 672 is received in the holder groove 671*b* of the stopper member 671, and an upper end of the holder 672 is installed to pass through a first through hole 622*a* of the second rack member. The first rack member 610 is pushed out by the preset distance to lead the second rack member 620, the holder 672 moved forward with the second rack member 620 is separated from the holder groove 671*b* and is received in the first receiving groove 614*a* of the first rack cover 614.

The holder 672 has inclined front upper and lower edges, and a front lower edge of the holder 672 is inclined at the same slope as the holder groove 671*b*. Thus, the holder 672 may be easily separated from the holder groove 671*b*.

The holder 672 has a cut groove 672*a* that is cut in forward and rearward direction on an upper surface of the holder 672, and an insert protrusion 614*c* received in the cut groove 672*a* is provided on a lower surface of the first rack cover 614, the lower surface thereof facing the upper surface of the holder 672, the insert protrusion 614*c* is formed from a front end of the first rack cover 614 to the first receiving groove 614*a*. That is, due to a structure between the cut groove 672*a* and the insert protrusion 614*c*, during movement of the first rack member 610, the holder 672 is prevented from being moved laterally so as to be precisely received in the first receiving groove 614*a*. The cut groove 672*a* and the insert protrusion 614*c* may be provided in plural.

The locking member 673 may prevent the forward movement of the second rack member 620 by being locked in a position of the rear of the confining protrusion part 650 until the first rack member 610 is pushed out by the preset distance.

The locking member 673 is moved upward when the first rack member 610 and the first rack cover 614 are pushed out by the preset distance and moved with the second rack member 620 and the second rack cover 624. Then, the locking member 673 is inserted in the second receiving groove 614*b* of the first rack cover 614 positioned above the locking member to be operated for releasing the engagement with the confining protrusion part 650.

An extending step 673*a* may be provided at an upper end of the locking member 673 in a shape of extending laterally, and a raising guide step 623 may be provided on opposite side portions of the second through hole 622*b* at a front upper surface of the second rack member 620. The raising guide step 623 may be formed in a rounded shape (or inclined shape) so as to raise the extended step 673*a* when the first rack member 610 and the first rack cover 614 are pushed out by the preset distance and moved with the second rack member 620 and the second rack cover 624.

That is, when the first rack member 610 and the first rack cover 614 are pushed out by the preset distance and moved with the second rack member 620 and the second rack cover 624, the raising guide step 623 provided on the second rack member 62 raises the extended step 673*a* of the locking member 673, thus the locking member 673 rises up to a height where the locking member 673 is not hit from the confining protrusion part 650.

The raising guide step 623 may be rounded or inclined upward such that the front is low and the rear is high. The raising guide step 623 may be gradually inclined upward such that the front (at the center of the opposite side portions of second through hole 622*b*) is low and the rear is high. That is, the raising guide step 623 is provided so that the locking member 673 is not affected by the raising guide step 623 when it is positioned in the front of second through hole 622*b*, and is gradually moved upward by affecting by the raising guide step 623 when the locking member 673 is moved to the rear of the second through hole 622*b* by the forward movement of the second rack member 620.

The extended step 673*a* of the locking member 673 may be preferably rounded or inclined like the raising guide step 623.

A lower surface of the locking member 673 may be inclined upward such that the front is low and the rear is high. A slope of the lower surface of the locking member 673 is the same as the slope 653 formed at the center of the upper surface of the confining protrusion part 650.

According to an embodiment of the present disclosure, operation of the refrigerator may be described.

Figure 29:
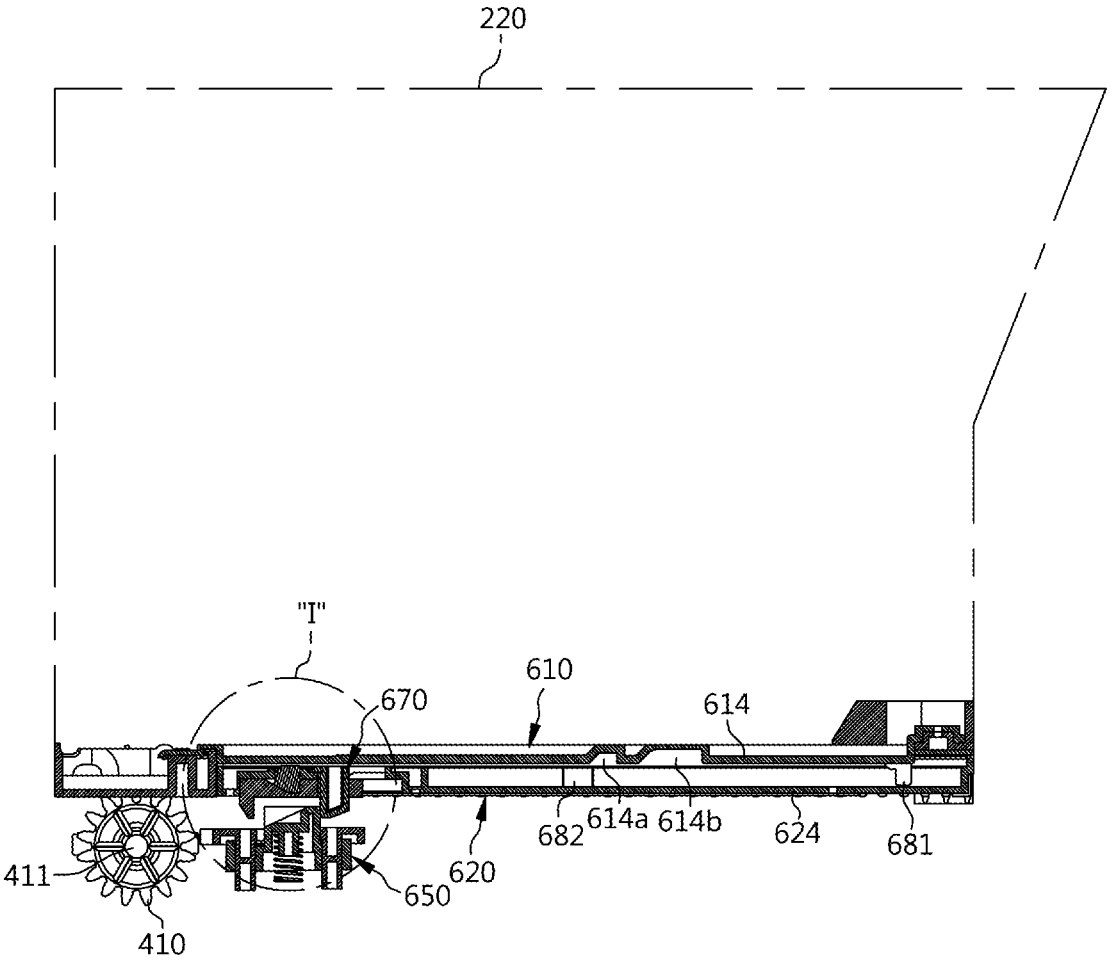
FIGS. 29, 31, 33, and 35 are views showing operational states of the rack gear assembly when the storage room of the refrigerator according to the embodiment of the present disclosure is opened.
Figure 30:
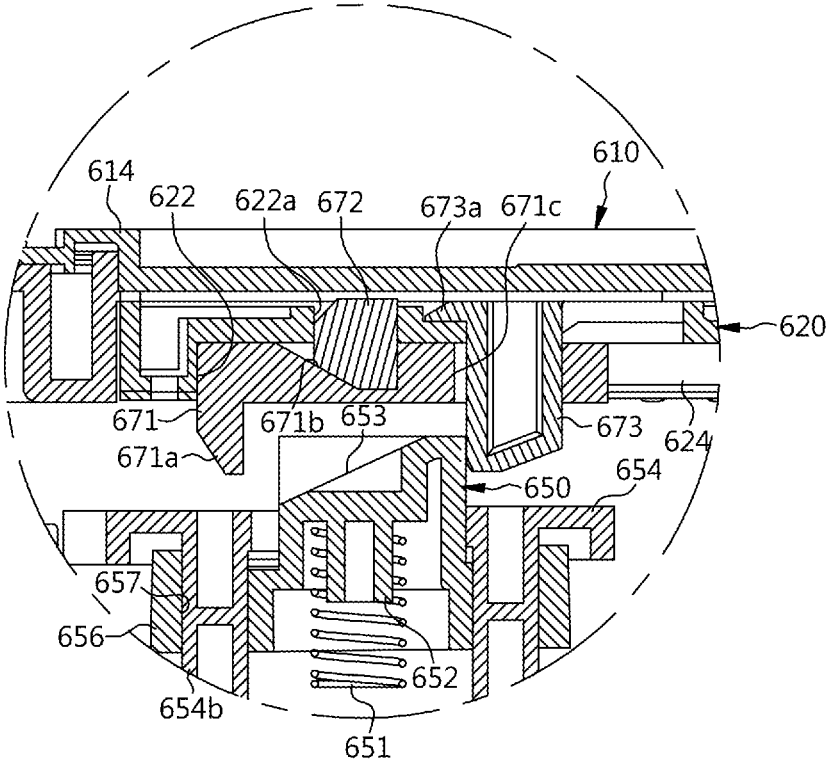
FIG. 30 is an enlarged view of "I" part in FIG. 29.
Figure 31:
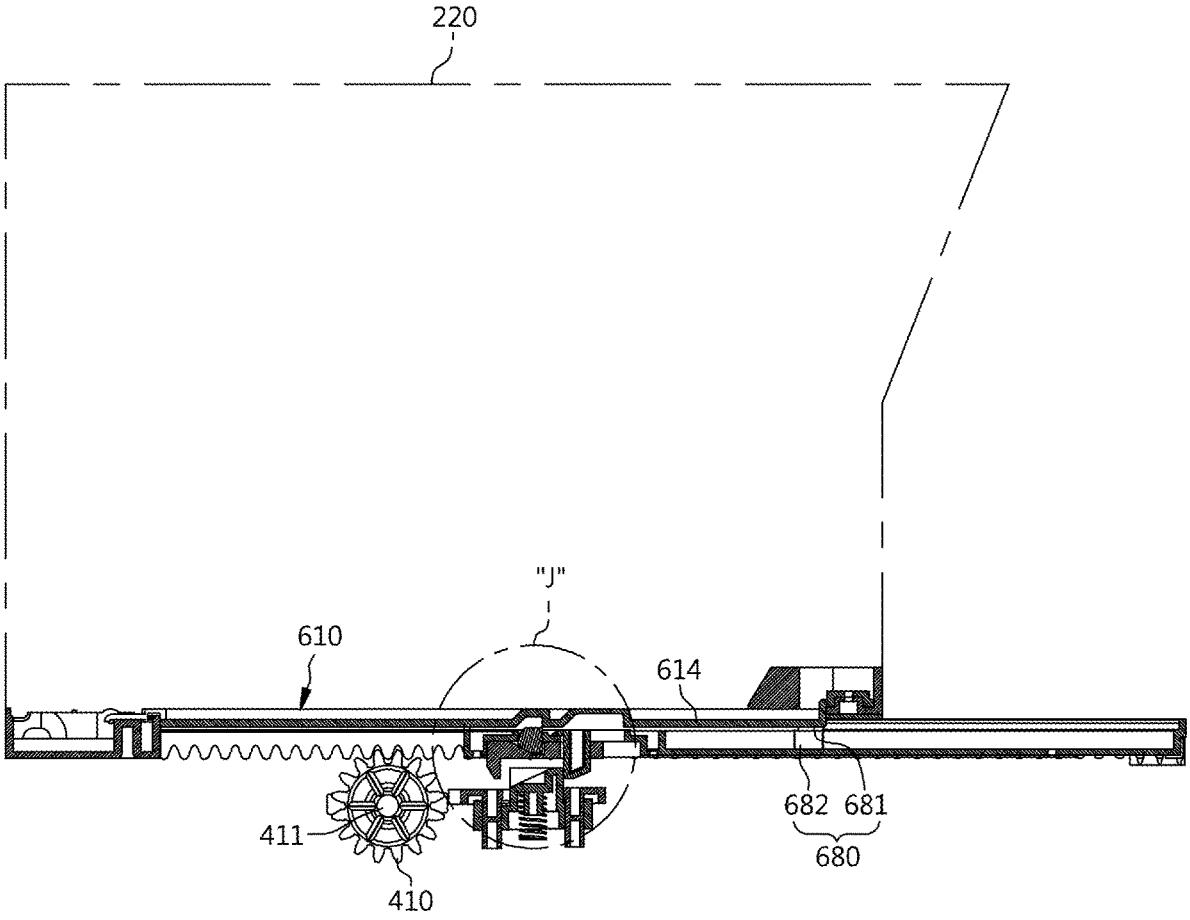
Figure 32:
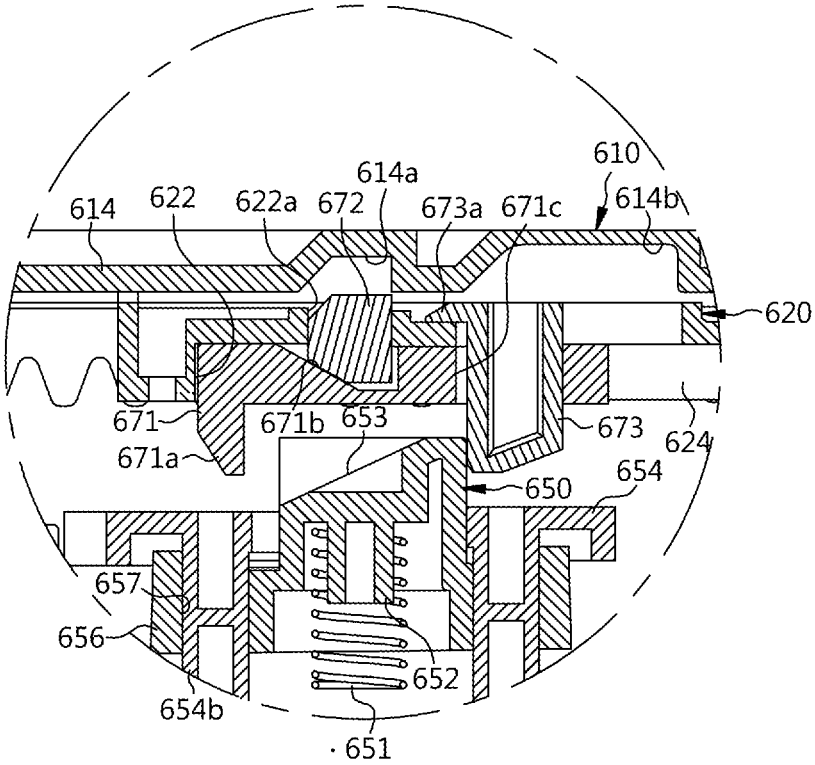
FIG. 32 is an enlarged view of "J" part in FIG. 31.
Figure 33:
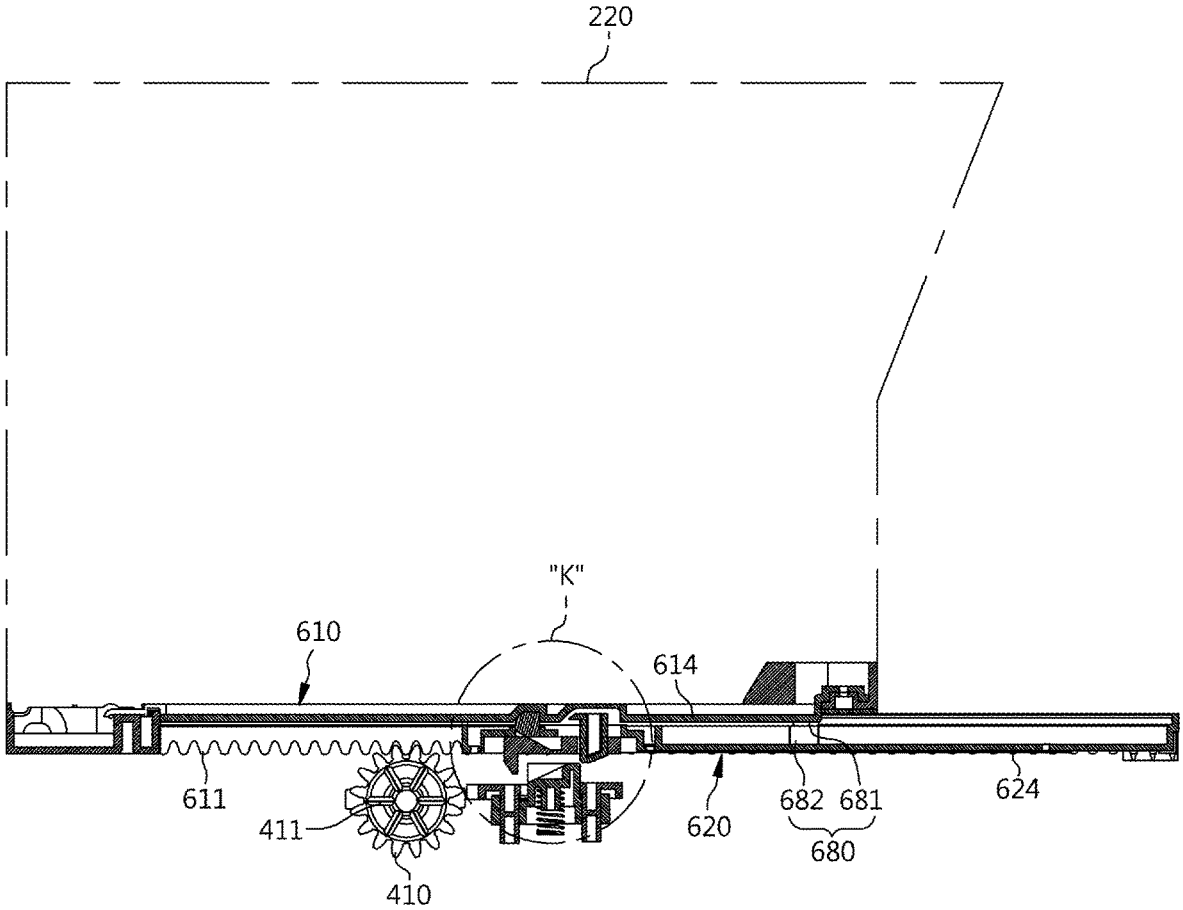
Figure 34:
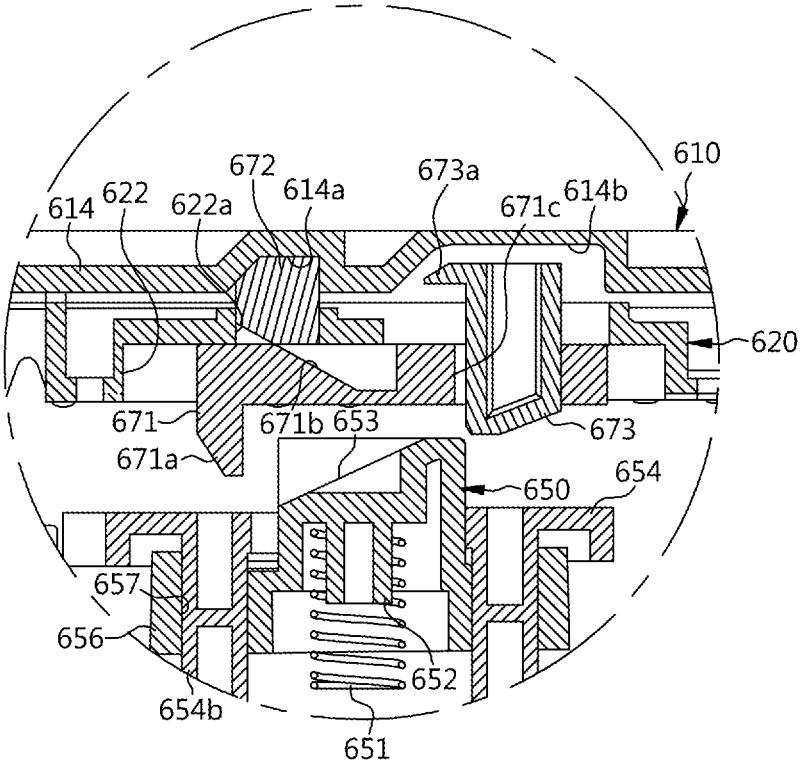
FIG. 34 is an enlarged view of "K" part in FIG. 33.
Figure 35:
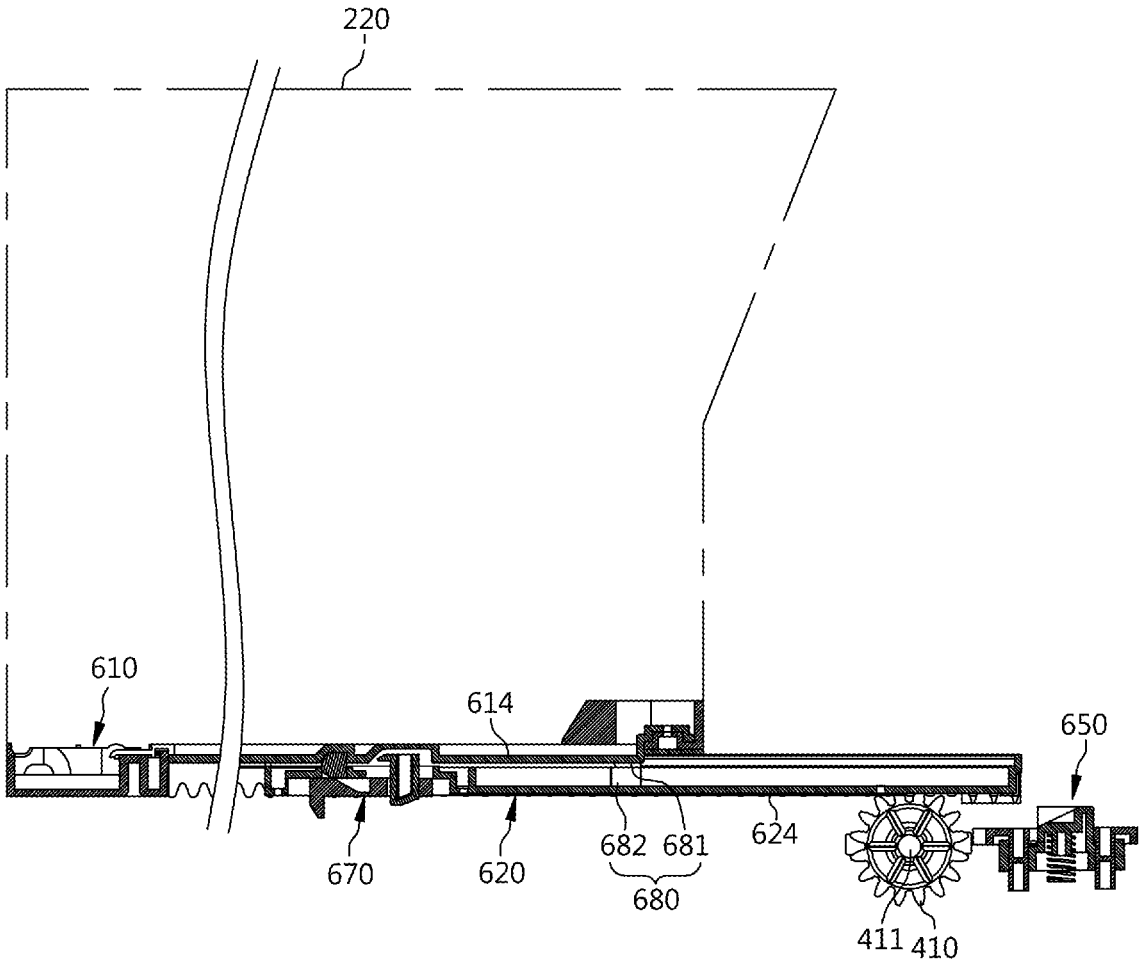

The drawer 200 may be maintained in a closed state unless otherwise manipulated, as shown in FIGS. 29 and 30.

In the closed state, when a manipulation is performed to open the drawer 200 at the user's need, the driving motor 420 may operate while power is supplied to the driving part 400.

The manipulation for opening the drawer 200 may be a manipulation of a button 6 (touch or pressure type) or an operation control of a control program that senses proximity of the user.

When the driving motor 420 is operated by the manipulation, the two pinions 410 may simultaneously rotate, and thus the drawer 200 is opened forward while the rack gears 611 and 621 (of the two rack gear assemblies 600 engaged with the pinions 410) are operated.

More specifically, the first rack member 610 and the first rack cover 614 are pushed out while being operated simultaneously, and then the second rack member 620 and the second rack cover 624 are subsequently pushed out.

While the first rack member 610 and the first rack cover 614 are simultaneously operated and pushed out, the locking member 673 is maintained in a confined state to the confining protrusion part 650, so that the second rack member 620 and the second rack cover 624 are maintained in an initial position.

When the first rack member 610 and the first rack cover 614 are pushed out by the preset first distance and the linkage protrusion 681 comes into contact with the linkage step 682, the second rack member 620 and the second rack cover 624 are also moved forward with the first rack member 610 from the contact point. This process may be shown in FIGS. 31 and 32.

However, at this time, the locking member 673 may be confined to the confining protrusion part 650, so the stopper member 671 through which the locking member 673 passes is maintained in place while the second rack member 620 is moved forward. In the above process, as the extended step 673*a* of the locking member 673 gradually climbs to the raising guide step 623 provided in the second rack member 620, the locking member 673 is moved upward and is separated from the confining protrusion part 650.

After that, the stopper member 671 is moved forward with the second rack member 620 while contacting with a rear surface in the motion groove 622 and passes the confining protrusion part 650. This operation may be shown in FIGS. 33 and 34.

Subsequently, while the second rack member 620 and the second rack cover 624 are moved following the first rack member 610 and the first rack cover 614, the rack gear 621 of the second rack member 620 is engaged with the pinion 410 just before the rack gear 611 of the first rack member 610 is separated from the pinion 410. As the rack gear 611 of the first rack member 610 is separated from the pinion 410 by rotation of the pinion 410 and at the same time only the rack gear 621 of the second rack member 620 is moved by being engaged with the pinion 410, the drawer 200 is further moved forward. This process may be shown in FIG. 35.

After movement of the second rack member 620 is finished, the storage bin 220 of the drawer 200 is in a maximum opened state. When the maximum opened state of the storage bin 220 is checked (for example, the maximum opened state is sensed by open/close sensing part), the raising/lowering module 300 may operate to raise up the container 240 in the storage bin 220.

Accordingly, the user can take out the container 240, take out storage items from the container 240, or put in items into the container 240 easily.

Meanwhile, when closing operation of the drawer 200 is performed as the user completes use thereof, the driving motor 420 (constituting the driving part 400) drives so that the pinion 410 is reversibly rotated, and thus the rack gear 621 of the second rack member 620, the rack gear 621 being engaged with the pinion 410, is operated so that the second rack member 620 is moved backward.

The first rack member 610 may be moved in conjunction with the second rack member 620 by the linkage part 680, and may be moved rearward with the second rack member 620.

After that, a front end of the rack gear 621 of the second rack member 620 is positioned to be engaged with the pinion 410, and a rear end of the rack gear 611 of the first rack member 610 is also positioned to be engaged with the pinion 410. The rack gear 621 of the second rack member 620 is separated from the pinion 410, and only the first rack member 610 is moved rearward by the rack gear 611 thereof.

When just before the second rack member 620 is fully moved rearward, the confining hook 671*a* of the stopper member 671 is blocked by the confining protrusion part 650, thereby no longer being moved rearward. Even though the stopper member 671 is hit, as the second rack member 620 is further moved by a moveable distance provided in the motion groove 622, the extended step 673*a* of the locking member 673 is separated from the locking member 673 so that the locking member 673 is moved downward.

After that, the second rack member 620 is also no longer moved backward by the stopper member 671, and the confining protrusion part 650 is positioned between the confining hook 671*a* of the stopper member 671 and the locking member 673 and confines the second rack member 620.

Accordingly, only the first rack member 610 is further moved rearward and returned to an initial position (position where storage room is fully pushed in). When completion of the return movement is sensed, the driving of the driving motor 420 is stopped and the closing movement of the drawer ends.

Meanwhile, when opening and closing operation of the drawer 200 is performed, the cable tray 500 (or cable tray device) is also moved in an opening or closing direction of the drawer 200.

That is, since the guide head 520 of the cable tray 500 is connected to the front panel 210 of the drawer 200, the cable tray 500 also moves forward and rearward when the drawer 200 is drawn out or drawn in.

The rotatable connection member 540 of the cable tray 500 is rotatably coupled to the bottom surface (more precisely, cover plate) in the lower storage chamber 3. The connecting members 530 at the bending section side S2 among the connecting members 530 connected between the rotatable connection member 540 and the guide head 520 are moved forward and rearward while being sequentially bent, and the connecting members 530 at the straight section side S1 are moved in the forward and rearward direction.

The hook member 52 is provided on the upper surface of the connecting member 530, the connecting member 530 being positioned at the rear end of the connecting members 530 at the straight section side S1, the connection guide 51 is provided on the lower surface of the storage bin 220, and the hook member 52 is suspended from the connection guide 51. Accordingly, when the drawer 200 is opened or closed, each of the connecting members 530 of the cable tray 500 is prevented from being dragged while contacting the bottom surface in the lower storage chamber 3.

Among each of the connecting members 530, the connecting members 530 at the straight section side S1 are configured to move forward and rearward. The connecting members 530 at the bending section side S2 may perform sequential bending movement (lateral flow) so that the connecting member 530 (connecting member where the hook member is provided) may be partially moved in the bending direction.

However, since the connection guide 51 is formed in a rounded shape and the hook member 52 is connected to the connection guide 51 to be moveable along the connection guide 51, the hook member 52 may be stably supported even when some shaking occurs.

Due to external factors such as shock, shaking, or quick opening and closing of the drawer 200, the hook member 52 may be separated from the connection guide 51.

When the hook member 52 is separated from the connection guide 561, the connecting members 530 constituting the cable tray 500 sag downward due to their own weight and contact the bottom surface in the lower storage chamber 3. Thus, noise of dragging on a floor is generated when the opening and closing operation of the drawer 200 is performed, and the user can recognize separation of the hook member 52 based on the noise.

In this example, the user can separate the shielding cover 53 from the storage bin 220, the shielding cover 53 being provided on the bottom surface in the storage bin 220, to open the guide exposure hole 221. Thus, the user can check whether the hook member 51 is connected precisely to the connection guide 51 exposed through the guide exposure hole 221.

When the hook member 52 is separated from the connection guide 51, the user can perform maintenance such as simple connecting, through the guide exposure hole 221. That is, an operation of connecting the hook member 52 to the connection guide 51 may be easily performed without separating the drawer 200 from the lower storage chamber 3.

Accordingly, since the tray guide part 50 is provided in the refrigerator, the cable tray 500 can be operated precisely.

In the refrigerator of the present disclosure, since a first end of the cable tray 500 is connected to the bottom surface in the lower storage chamber 3, the cables can be connected along the bottom surface in the lower storage chamber 3.

In the refrigerator of the present disclosure, since the first end of the cable tray 500 is connected to a front portion of the bottom surface in the storage chamber 3, and a second end of the cable tray 500 is connected to a lower end portion of the rear surface of the front panel 210, an installation height can be minimized, thus the storage bin 220 can be formed larger by minimizing a space required for cable connection.

Since the refrigerator of the present disclosure is provided with the plurality of connecting members 530 that are connected to each other to be bendable from side to side, the cables can be guided smoothly when the drawer 200 is moved.

Since the refrigerator of the present disclosure is provided with the tray guide part 50 including the connection guide 51 and the hook member 52, connection between the connection guide 51 and the hook member 52 can be easily performed.

In the refrigerator of the present disclosure, since the connection guide 51 is provided on the lower surface of the storage bin 220 (of the drawer 200) and the hook member 52 is provided on the upper surface of any one connecting member 530, the cable tray 500 can be maintained in the suspended state from the storage bin 220 and the installation height thereof can be minimized.

In the refrigerator of the present disclosure, since the hook member 52 is provided on the connecting member 530 at the straight section side S1, the hook member 52 can be moved forward and rearward precisely with the drawer 200.

In the refrigerator of the present disclosure, since the hook member 52 is provided on the connecting member 530 positioned at the rear end of the connecting members 530 at the straight section side S1, sagging of the connecting members 530 can be prevented regardless of their own weight.

In the refrigerator of the present disclosure, the connection guide 51 is connected with the hook member 52 while being positioned on the lower surface of the storage bin 220 and facing the hook member 52, connection between the connection guide and the hook member can be performed precisely.

In the refrigerator of the present invention, the connection guide 51 is connected with the hook member 52 while being spaced apart from the lower surface of the storage bin 220, interference 52 can be prevented when the hook member 52 is operated.

In the refrigerator of the present disclosure, since the hook member 52 has the hook groove 52*a* and the connection guide 51 is installed to be inserted into the hook groove 52*a*, the hook member 52 and the connection guide 51 are maintained in a stable coupling state.

In the refrigerator of the present disclosure, since the hook groove 52*a* is formed on the upper surface of the hook member 52 by being open upward and the width of the open portion that is provided on the upper surface of the hook member 52 is formed narrower than the width of the inside portion of the hook groove 52*a*, accidental removal of the connection guide 51 inserted in the hook groove 52*a* is prevented.

In the refrigerator of the present disclosure, since the connection guide 51 is formed to have the larger diameter than the width of the open portion of the hook groove 52*a*, and the diameter is equal to or smaller than the width of the inside portion of the hook groove 52*a*, the connection guide 51 can be prevented from being separated from the inside of the hook groove 52*a* and the hook member 52 can be moved smoothly along the connection guide 51.

In the refrigerator of the present disclosure, since the connection guide 51 is formed in the bar or the rod structure, the hook member 52 can move along the connection guide 51.

In the refrigerator of the present disclosure, since the opposite ends of the connection guide 51 are installed to face the opposite wall surfaces of the drawer 200, even when the cable tray 500 is shaken from side to side when the drawer 200 is moved forward and rearward, the shaking can be eliminated.

In the refrigerator of the present disclosure, since the connection guide 51 is formed round such that the opposite sides thereof is further forward than the center thereof, it is possible to easily eliminate the shaking caused when the straight movement of the connecting members 530 at the straight section side S1 and the bending movement of the connecting members 530 at the bending section side S2 are performed simultaneously.

In the refrigerator of the present disclosure, since the guide exposure hole 221 is provided on the lower surface of the storage bin 220 (of the drawer 200) to expose at least a part of the connection guide 51, the connection state between the connection guide 51 and the hook member 52 can be easily checked.

In the refrigerator of the present disclosure, since the guide exposure hole 221 is formed so that the entire portion of the connection guide 51 is exposed, the connection state between the connection guide 51 and the hook member 52 can be accurately checked.

In the refrigerator of the present disclosure, since the guide exposure hole 221 is formed such that the center portion thereof is open larger than the other portions thereof, the operation of connecting the hook member 52 to the connection guide 51 can be easily performed.

In the refrigerator of the present disclosure, since the shielding cover 53 is provided on the bottom surface in the storage bin 220 for shielding the guide exposure hole 221, it is possible to prevent the entering of foreign materials into the storage bin 220.

In the refrigerator of the present disclosure, since the cover seating groove 222 on which the shielding cover 53 is seated is provided around the circumference of the guide exposure hole 221, it is possible to prevent the shielding cover 53 from being inadvertently peeled off by the storage items in the storage bin 220.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

This application is also related to U.S. application Ser. No. 16/583,726 filed Sep. 26, 2019, U.S. application Ser. No. 16/582,647 filed Sep. 25, 2019, U.S. application Ser. No. 16/582,518 filed Sep. 25, 2019, U.S. application Ser. No. 16/582,605 filed Sep. 25, 2019, U.S. application Ser. No. 16/582,712 filed Sep. 25, 2019, U.S. application Ser. No. 16/582,756 filed Sep. 25, 2019, U.S. application Ser. No. 16/582,810 filed Sep. 25, 2019, U.S. application Ser. No. 16/582,755 filed Sep. 25, 2019, U.S. application Ser. No. 16/582,831 filed Sep. 25, 2019, U.S. application Ser. No. 16/585,284 filed Sep. 27, 2019, U.S. application Ser. No. 16/585,301 filed Sep. 27, 2019, and U.S. application Ser. No. 16/585,816 filed Sep. 27, 2019, whose entire disclosures are also hereby incorporated by reference.

What is claimed is:

1. A refrigerator comprising:

a cabinet having an opening to access a storage chamber provided within the cabinet;

a drawer including a front panel and a storage bin coupled to a rear of the front panel, the drawer being coupled to the cabinet such that the drawer moves between a first position in which the front panel closes the opening of the cabinet and the storage bin is received in the storage chamber, and a second position in which the front panel is spaced away from the opening of the cabinet and at least a portion of the storage bin is positioned outside of the storage chamber;

a cable support device positioned between a bottom surface in the storage chamber and a lower surface of the storage bin and having a cable housing that extends from a first end to a second end, the first end provided on a wall surface of the storage chamber and the second end connected to the front panel, the cable support device to come out of and enter the storage chamber together with the drawer, and the cable support device to protect a cable that is coupled to an electronic device at the front panel; and a guide coupled to the cable support device and to the storage bin to which the cable housing is connected, and the guide to allow the cable housing to move based on movement of the drawer, wherein the cable support device is connected to the guide and is configured to come out of and enter the storage chamber together with the drawer while being suspended from the lower surface of the storage bin.

2. The refrigerator of claim 1, wherein the first end of the cable housing is connected to a bottom surface of the storage chamber, and the cable is connected along an inside of a bottom of the storage chamber and passes through the bottom surface to the cable support device.

3. The refrigerator of claim 2, wherein the first end of the cable housing is connected to a front portion of the bottom surface in the storage chamber and the second end of the cable housing is connected to a lower end portion of a rear of the front panel.

4. The refrigerator of claim 1, wherein the cable housing comprises a plurality of connecting members, the connecting members being connected to each other to be bendable from side to side and being provided as a tubular body through which the cable passes.

5. The refrigerator of claim 4, wherein the guide comprises:

a connection guide provided at the lower surface of the storage bin; and a hook member provided at an upper surface of at least one of the connecting members.

6. The refrigerator of claim 5, wherein the connecting members comprise connecting members arranged at a straight section of the cable housing, the connecting members at the straight section to form a straight line in a moving direction of the drawer from a connection portion with the drawer, in a closed state of the drawer.

7. The refrigerator of claim 6, wherein the hook member of the guide is provided at one of the connecting members at the straight section of the cable housing.

8. The refrigerator of claim 7, wherein the hook member is provided at one connecting member that is positioned at a rear of the connecting members at the straight section of the cable housing.

9. The refrigerator of claim 7, wherein the hook member is to protrude from an upper surface of the connecting member positioned at a rear of the connecting members at the straight section of the cable housing to the connection guide of the guide is at a portion of the lower surface of the storage bin, so that the hook member is connected to the connection guide.

10. The refrigerator of claim 5, wherein the connection guide is spaced apart from the lower surface of the storage bin and is connected to the hook member.

11. The refrigerator of claim 10, wherein the hook member includes a hook groove, and the connection guide is to be inserted into the hook groove.

12. The refrigerator of claim 11, wherein the hook groove is on an upper surface of the hook member and has an open portion that is upwardly opened, a width of the open portion of the hook groove is narrower than a width of an inside portion of the hook groove, and the connection guide has a diameter larger than the width of the open portion of the hook groove, but equal to or smaller than the width of the inside portion of the hook groove.

13. The refrigerator of claim 11, wherein the connection guide is shaped in a bar or a rod structure, and opposite ends of the connection guide are disposed to face opposite wall surfaces of the drawer.

14. The refrigerator of claim 13, wherein the connection guide is rounded such that the opposite ends thereof are further forward than a center of the connection guide.

15. The refrigerator of claim 14, wherein the hook member is moveable along the connection guide.

16. The refrigerator of claim 5, wherein the lower surface of the storage bin includes a guide stopper exposure hole to expose at least a portion of the connection guide.

17. The refrigerator of claim 16, wherein the guide stopper exposure hole is to expose an entire portion of the connection guide.

18. The refrigerator of claim 16, wherein the guide stopper exposure hole is configured such that a center portion is open larger than other portions of the guide stopper exposure hole.

19. The refrigerator of claim 16, wherein a shielding cover is provided on a bottom surface in the storage bin for shielding the guide stopper exposure hole.

20. The refrigerator of claim 19, wherein a cover seating groove is provided on the bottom surface in the storage bin by being formed in a step shape around a circumference of the guide stopper exposure hole, and the shielding cover is seated on the cover seating groove.

* * * * *